US008474400B2

(12) United States Patent
McGlinchy et al.

(10) Patent No.: US 8,474,400 B2
(45) Date of Patent: Jul. 2, 2013

(54) DESICCANT DISPENSING SYSTEM

(75) Inventors: Timothy B. McGlinchy, Twinsburg, OH (US); John Grismer, Cuyahoga Falls, OH (US)

(73) Assignee: GED Integrated Solutions, Inc., Twinsburg, OH (US)

( * ) Notice: Subject to any disclaimer, the term of this patent is extended or adjusted under 35 U.S.C. 154(b) by 866 days.

(21) Appl. No.: 12/609,469

(22) Filed: Oct. 30, 2009

(65) Prior Publication Data

US 2010/0065580 A1 Mar. 18, 2010

Related U.S. Application Data

(60) Division of application No. 12/537, 528, filed on Aug. 7, 2009, now Pat. No. 8,056,234, and a continuation-in- part of application No. 11/085,711, filed on Mar. 21, 2005, now Pat. No. 7,610,681.

(60) Provisional application No. 60/614,308, filed on Sep. 29, 2004.

(51) Int. Cl.
*B05B 3/00* (2006.01)
*B05D 5/00* (2006.01)

(52) U.S. Cl.
USPC ..... 118/323; 427/427.3

(58) Field of Classification Search
None
See application file for complete search history.

(56) References Cited

U.S. PATENT DOCUMENTS

| | | | |
|---|---|---|---|
| 2,632,641 | A | 3/1953 | Rice |
| 3,280,523 | A | 10/1966 | Stroud et al. |
| 3,692,223 | A | 9/1972 | Laigle et al. |
| 3,788,370 | A | 1/1974 | Hare et al. |
| 3,854,509 | A | 12/1974 | Bailey |
| 4,088,522 | A | 5/1978 | Mercier et al. |
| 4,145,237 | A | 3/1979 | Mercier et al. |
| 4,530,195 | A | 7/1985 | Leopold |
| 4,546,723 | A | 10/1985 | Leopold et al. |
| 4,564,410 | A | 1/1986 | Clitheros et al. |
| 4,628,582 | A | 12/1986 | Leopold |
| 4,787,332 | A | 11/1988 | Geisel et al. |
| 4,964,362 | A | 10/1990 | Dominguez |
| 5,044,309 | A | 9/1991 | Crumbach et al. |
| 5,105,591 | A | 4/1992 | Leopold |
| 5,136,974 | A | 8/1992 | Lisec |
| 5,295,292 | A | 3/1994 | Leopold |
| 5,313,761 | A | 5/1994 | Leopold |
| 5,332,166 | A | 7/1994 | Kepes |
| 5,361,476 | A | 11/1994 | Leopold |
| 5,678,377 | A | 10/1997 | Leopold |
| 5,932,062 | A | 8/1999 | Manser |
| 6,017,578 | A | 1/2000 | Trautmann et al. |
| 6,173,484 | B1 | 1/2001 | McGlinchy et al. |

(Continued)

FOREIGN PATENT DOCUMENTS

| | | |
|---|---|---|
| EP | 0709539 | 5/1996 |
| EP | 1213431 | 6/2002 |

*Primary Examiner* — Dah-Wei Yuan
*Assistant Examiner* — Charles Capozzi
(74) *Attorney, Agent, or Firm* — Tarolli, Sundheim, Covell & Tummino LLP

(57) ABSTRACT

A method and apparatus for controlling dispensing of a desiccant material into an interior region of an elongated spacer frame member. The appropriate desiccant dispensing nozzle is automatically selected and/or the distance between the desiccant dispensing nozzle and the elongated spacer frame member is automatically determined based on a property of the spacer frame member, such as the width of the spacer frame member.

19 Claims, 17 Drawing Sheets

U.S. PATENT DOCUMENTS

| | | | |
|---|---|---|---|
| 6,197,231 | B1 | 3/2001 | Lisec |
| 6,244,012 | B1 | 6/2001 | McGlinchy et al. |
| 6,286,288 | B1 | 9/2001 | France |
| 6,293,317 | B1 | 9/2001 | Burgi et al. |
| 6,368,408 | B1 | 4/2002 | Schuler |
| 6,397,453 | B1 | 6/2002 | McGlinchy et al. |
| 6,438,819 | B1 | 8/2002 | McGlinchy et al. |
| 6,470,562 | B1 | 10/2002 | Simone et al. |
| 6,494,245 | B1 | 12/2002 | Simone |
| 6,618,926 | B2 | 9/2003 | McGlinchy et al. |
| 6,630,028 | B2 | 10/2003 | Briese et al. |
| 6,651,304 | B2 | 11/2003 | McGlinchy et al. |
| 6,678,938 | B2 | 1/2004 | McGlinchy et al. |
| 6,687,982 | B2 | 2/2004 | McGlinchy |
| 6,708,384 | B2 | 3/2004 | McGlinchy |
| 6,722,403 | B2 | 4/2004 | Zhou et al. |
| 6,742,285 | B2 | 6/2004 | Sheperd |
| 6,745,460 | B2 | 6/2004 | McGlinchy |
| 6,851,460 | B2 | 2/2005 | Tamai |
| 6,868,884 | B2 | 3/2005 | Briese |
| 6,883,278 | B2 | 4/2005 | McGlinchy et al. |
| 6,889,416 | B2 | 5/2005 | McGlinchy |
| 2002/0063184 | A1 | 5/2002 | Walker |
| 2003/0029960 | A1 | 2/2003 | Boone et al. |
| 2005/0178490 | A1 | 8/2005 | McGlinchy |
| 2006/0037665 | A1 * | 2/2006 | McGlinchy et al. ..... 141/283 |
| 2006/0075719 | A1 | 4/2006 | James et al. |

* cited by examiner

DESICCANT DISPENSING SYSTEM

CROSS REFERENCES TO RELATED APPLICATIONS

The following application is a Continuation-in-Part Application that claims priority from U.S. application Ser. No. 11/085,711 filed Mar. 21, 2005 entitled WINDOW COMPONENT STOCK INDEXING, having a claim of priority from U.S. Provisional Application Ser. No. 60/614,308 filed Sep. 29, 2004, and the following application also claims priority from U.S. Divisional application Ser. No. 12/537,528 filed Aug. 7, 2009 entitled *WINDOW COMPONENT STOCK INDEXING*. All of the aforementioned patent applications are incorporated herein by reference in their entirety for all purposes.

FIELD OF THE INVENTION

The present invention relates to insulating glass units and, more particularly, to a method and apparatus for applying desiccant to spacer frame assemblies used in constructing insulating glass units.

BACKGROUND

Insulating glass units (IGU's) are used in windows to reduce heat loss from building interiors during cold weather or to reduce heat gain in building interiors during hot weather. IGU's are typically formed by a spacer assembly that is sandwiched between glass lites. The spacer assembly usually comprises a frame structure that extends peripherally around the unit, an adhesive material that adheres the glass lites to opposite sides of the frame structure, and desiccant in an interior region of the frame structure for absorbing atmospheric moisture within the IGU. The glass lites are flush with or extend slightly outwardly from the spacer assembly. The adhesive is disposed on opposite outer sides of the frame structure about the frame structure periphery, so that the spacer is hermetically sealed to the glass lites. An outer frame surface that defines the spacer periphery may also be coated with sealant, which increases the rigidity of the frame and acts as a moisture barrier.

One type of spacer construction employs a U-shaped, roll formed aluminum or steel elements connected at its end to form a square or rectangular spacer frame. Opposite sides of the frame are covered with an adhesive (e.g., a hot melt material) for securing the frame to the glass lites. The adhesive provides a barrier between atmospheric air and the IGU interior. Desiccant is deposited in an interior region of the U-shaped frame element. The desiccant is in communication with the air trapped in the IGU interior and removes any entrapped water vapor and thus impedes water vapor from condensing within the IGU. After the water vapor entrapped in the IGU is removed, internal condensation only occurs when the seal between the spacer assembly and the glass lites fails or the glass lites are cracked.

SUMMARY

The present invention concerns a method and apparatus for controlling dispensing of a desiccant material into an interior region of an elongated spacer frame member. The appropriate desiccant dispensing nozzle is automatically selected and/or the distance between the desiccant dispensing nozzle and the elongated spacer frame member is automatically determined based on a property of the spacer frame member, such as the width of the spacer frame member.

In one embodiment of the method, one of a plurality of nozzles is indexed to a delivery site located along a path of travel of the elongated spacer frame member. The elongated spacer frame member is moved along the path of travel relative to the delivery site at a controlled speed. Controlled amounts of the desiccant material are dispensed through the nozzle at the delivery site to the interior region of the elongated spacer frame member. A width of the elongated spacer frame member may be monitored in a variety of ways and an appropriate nozzle can automatically be indexed to the delivery site based on the monitored width of the spacer frame member.

In one embodiment of the method, one or more of the nozzles are used to dispense desiccant material into elongated spacer members having a range of widths. For example, when a first elongated spacer frame member having a first width is moved toward the delivery site, a nozzle is automatically positioned at a first distance above the path of travel that corresponds to the first width. The nozzle delivers controlled amounts of the desiccant material to the interior region of the first elongated spacer frame member. When a second elongated spacer frame member having a second width is moved toward the nozzle, the nozzle is automatically positioned at a second distance above the path of travel that corresponds to the second width. Controlled amounts of the desiccant material are dispensed through the nozzle to the interior region of the second elongated spacer frame member. In one embodiment, the width of the desiccant material applied by the nozzle at the delivery site to the elongated spacer frame member is adjusted by adjusting the relative distance between the spacer frame member and the nozzle at the delivery site.

In one embodiment, the volume of desiccant material per unit of spacer frame member length is selected based on a moisture vapor transfer rate of an insulated glass unit constructed with the elongated spacer frame member. The volume of desiccant material per unit of spacer frame member length may be constant for a range of spacer frame widths.

One system for controlled dispensing of a desiccant material into an interior region of an elongated spacer frame member includes a plurality of nozzles, a nozzle indexing actuator, a conveyor and a controller. The actuator selectively indexes each of the plurality of nozzles to a delivery site located along a path of travel of the elongated spacer frame member. The conveyor moves the elongated spacer frame members along the path of travel relative to the delivery site at a controlled speed. The controller selects a nozzle indexed to the delivery site based on a width of an elongated spacer frame member approaching the delivery site.

Another system for controlled dispensing includes a nozzle, a nozzle adjustment actuator, a conveyor and a controller. The nozzle adjustment actuator positions the nozzle above a delivery site located along a path of travel of the elongated spacer frame member. The controller determines the distance between the nozzle and the elongated spacer frame member at the delivery site based on a width of an elongated spacer frame member approaching the delivery site.

Additional features of the invention will become apparent and a fuller understanding obtained by reading the following detailed description in connection with the accompanying drawings.

DETAILED DESCRIPTION

Figure 1:
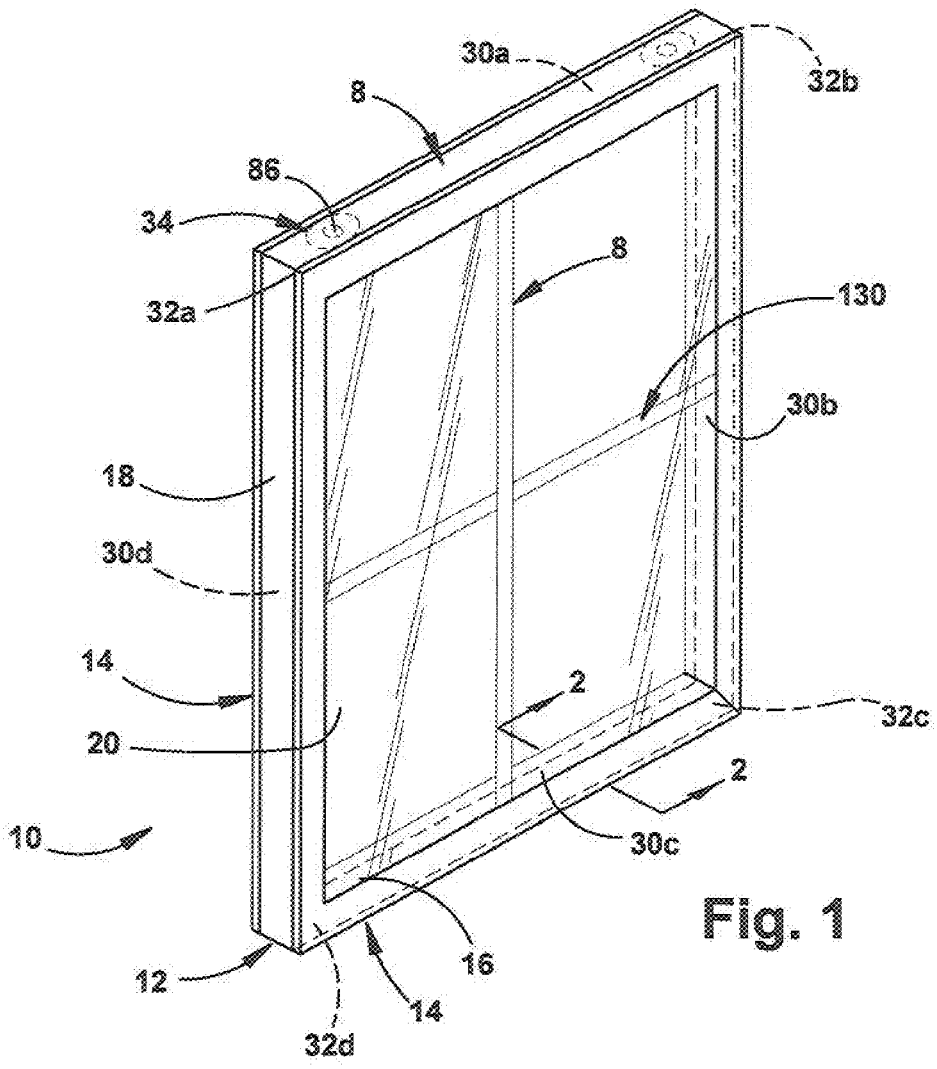
FIG. 1 is perspective view of an insulating glass unit.
Figure 2:
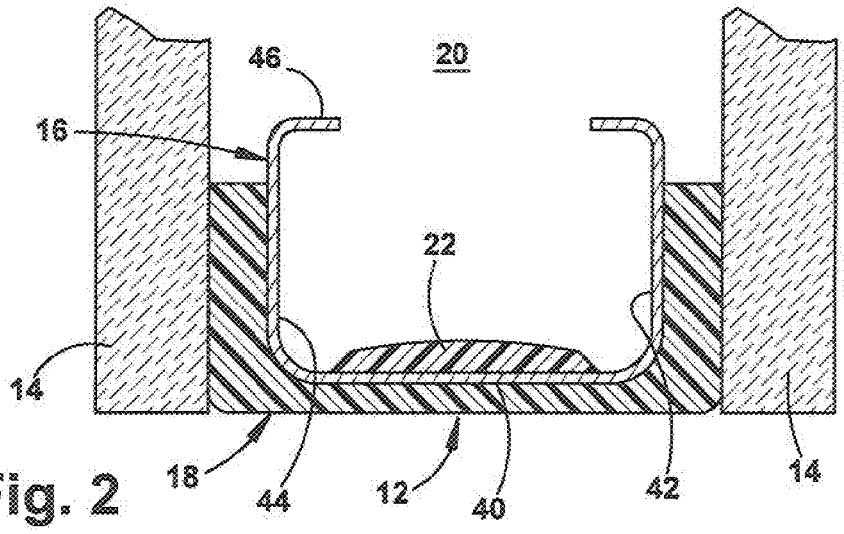
FIG. 2 is a cross sectional view seen approximately from the plane indicated by the line 2-2 of FIG. 1.

The drawing Figures and following specification disclose a method and apparatus for producing elongated window components 8 used in insulating glass units. Examples of elongated window components include spacer assemblies 12 and muntin bars 130 that form parts of insulating glass units. The new method and apparatus are embodied in a production line which forms sheet metal ribbon-like stock material into muntin bars and/or spacers carrying sealant and desiccant for completing the construction of insulating glass units. While the elongated window components illustrated as being produced by the disclosed method and apparatus are spacers, the claimed method and apparatus may be used to produce any type of elongated window component, including muntin bars.

The Insulating Glass Unit

An insulating glass unit 10 constructed using the method and apparatus of the present invention is illustrated by FIGS. 1-6 as comprising a spacer assembly 12 sandwiched between glass sheets, or lites, 14. The assembly 12 comprises a frame structure 16, sealant material 18 for hermetically joining the frame to the lites to form a closed space 20 within the unit 10 and a body 22 of desiccant in the space 20. Sec FIG. 2. The unit 10 is illustrated in FIG. 1 as in condition for final assembly into a window or door frame, not illustrated, for ultimate installation in a building. The unit 10 illustrated in FIG. 1 includes muntin bars 130 that provide the appearance of individual window panes.

The assembly 12 maintains the lites 14 spaced apart from each other to produce the hermetic insulating "insulating air space" 20 between them. The frame 16 and the sealant body 18 co-act to provide a structure which maintains the lites 14 properly assembled with the space 20 sealed from atmospheric moisture over long time periods during which the unit 10 is subjected to frequent significant thermal stresses. The desiccant body 22 removes water vapor from air, or other volatiles, entrapped in the space 20 during construction of the unit 10.

The sealant body 18 both structurally adheres the lites 14 to the spacer assembly 12 and hermetically closes the space 20 against infiltration of airborne water vapor from the atmosphere surrounding the unit 10. The illustrated body 18 is formed from a "hot melt" material which is attached to the frame sides and outer periphery to form a U-shaped cross section.

The structural elements of the frame 16 are produced by the method and apparatus of the present invention. The frame 16 extends about the unit periphery to provide a structurally strong, stable spacer for maintaining the lites aligned and spaced while minimizing heat conduction between the lites via the frame. The preferred frame 16 comprises a plurality of spacer frame segments, or members, 30*a-d* connected to form a planar, polygonal frame shape, element juncture forming frame corner structures 32*a-d*, and connecting structure 34 for joining opposite frame element ends to complete the closed frame shape.

Each frame member 30 is elongated and has a channel shaped cross section defining a peripheral wall 40 and first and second lateral walls 42, 44. See FIG. 2. The peripheral wall 40 extends continuously about the unit 10 except where the connecting structure 34 joins the frame member ends. The lateral walls 42, 44 are integral with respective opposite peripheral wall edges. The lateral walls extend inwardly from the peripheral wall 40 in a direction parallel to the planes of the lites and the frame. The illustrated frame 16 has stiffening flanges 46 formed along the inwardly projecting lateral wall edges. The lateral walls 42, 44 add rigidity the frame member 30 so it resists flexure and bending in a direction transverse to its longitudinal extent. The flanges 46 stiffen the walls 42, 44 so they resist bending and flexure transverse to their longitudinal extents.

Figure 3:
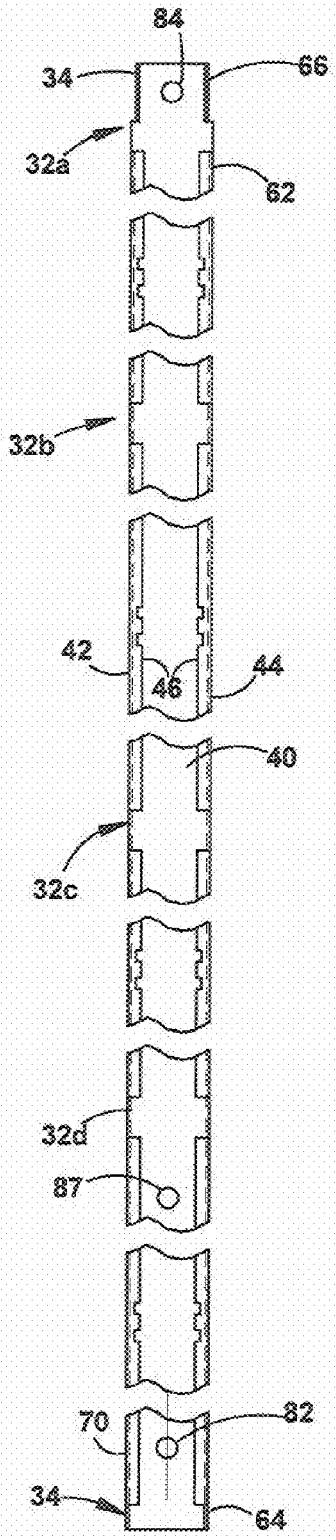
FIG. 3 is a fragmentary plan view of a spacer frame element before the element has had sealant applied and in an unfolded condition.
Figure 4:
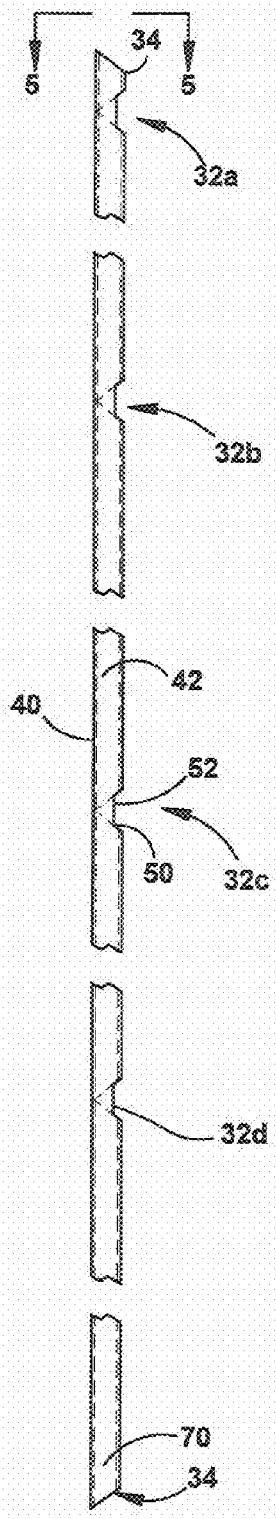
FIG. 4 is a fragmentary elevational view of the element of FIG. 3.
Figure 5:
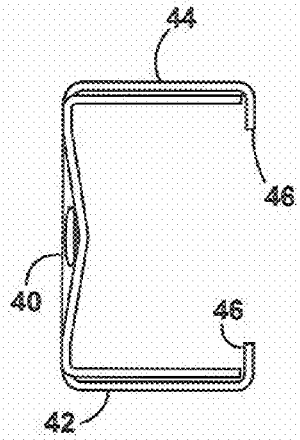
FIG. 5 is an enlarged elevational view seen approximately from the plane indicated by the line 5-5 of FIG. 4.
Figure 6:
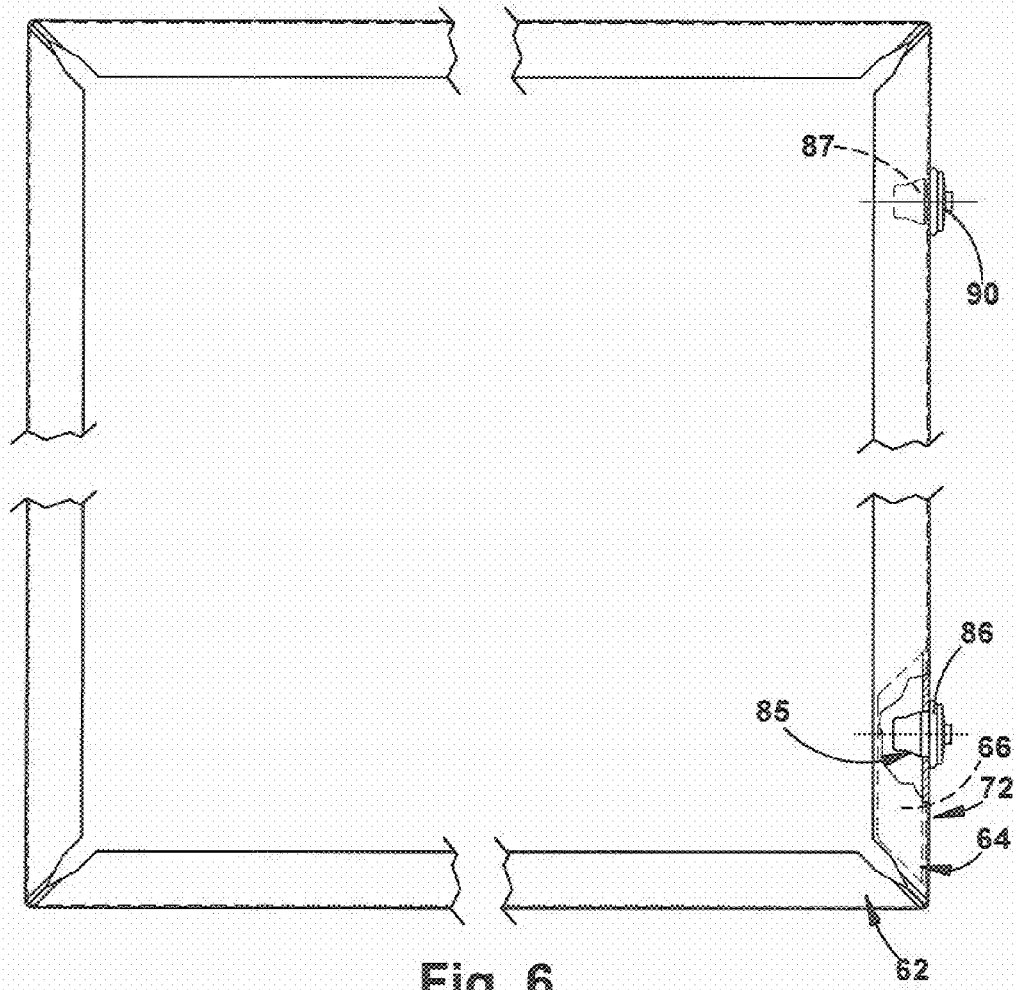
FIG. 6 is a fragmentary elevational view of a spacer frame forming part of the unit of FIG. 1, which is illustrated in a partially constructed condition.

The frame is initially formed as a continuous straight channel constructed from a thin ribbon of stainless steel material (e.g., 304 stainless steel having a thickness of 0.006-0.010 inches). Other materials, such as galvanized, tin plated steel, or aluminum, may also be used to construct the channel. The corner structures 32 are made to facilitate bending the frame channel to the final, polygonal frame configuration in the unit 10 while assuring an effective vapor seal at the frame corners as seen in FIGS. 3-5. The sealant body 18 is applied and adhered to the channel before the corners are bent. The corner structures 32 initially comprise notches 50 and weakened zones 52 formed in the walls 42, 44 at frame corner locations. See FIGS. 3-6. The notches 50 extend into the walls 42, 44 from the respective lateral wall edges. The lateral walls 42, 44 extend continuously along the frame 16 from one end to the other. The walls 42, 44 are weakened at the corner locations because the notches reduce the amount of lateral wall material and eliminate the stiffening flanges 46 and because the walls are stamped to weaken them at the corners.

The connecting structure 34 secures the opposite frame ends 62, 64 together when the frame has been bent to its final configuration. The illustrated connecting structure comprises a connecting tongue structure 66 continuous with and projecting from the frame structure end 62 and a tongue receiving structure 70 at the other frame end 64. The preferred tongue and tongue receiving structures 66, 70 are constructed and sized relative to each other to form a telescopic joint 72. See FIG. 6. When assembled, the telescopic joint 72 maintains the frame in its final polygonal configuration prior to assembly of the unit 10.

In the illustrated embodiment, the connector structure 34 further comprises a fastener arrangement 85 for both connecting the opposite frame ends together and providing a temporary vent for the space 20 while the unit 10 is being fabricated. The illustrated fastener arrangement (see FIGS. 3 and 6) is formed by connector holes 84, 82 located, respectively, in the tongue 66 and the frame end 64, and a rivet 86 extending through the connector holes 82, 84 for clinching the tongue 66 and frame end 64 together. The connector holes are aligned when the frame ends are properly telescoped together and provide a gas passage before the rivet is installed.

In some circumstances it may be desirable to provide two gas passages in the unit 10 so the inert gas flooding the space 20 can flow into the space 20 through one passage displacing residual air from the space through the second passage. The drawings show such a unit. See FIGS. 3 and 6. The second passage 87 is formed by a punched hole in the frame wall 40 spaced along the common frame member from the connector hole 84. The sealant body 18 and the desiccant body 22 each defines an opening surrounding the hole 84 so that air venting from the space 20 is not impeded. The second passage 87 is closed by a blind rivet 90 identical to the rivet 86. The rivets 86, 90 are installed at the same time and each is covered with sealant material so that the seal provided by each rivet is augmented by the sealant material.

The Elongated Window Component Production Line

Figure 7:
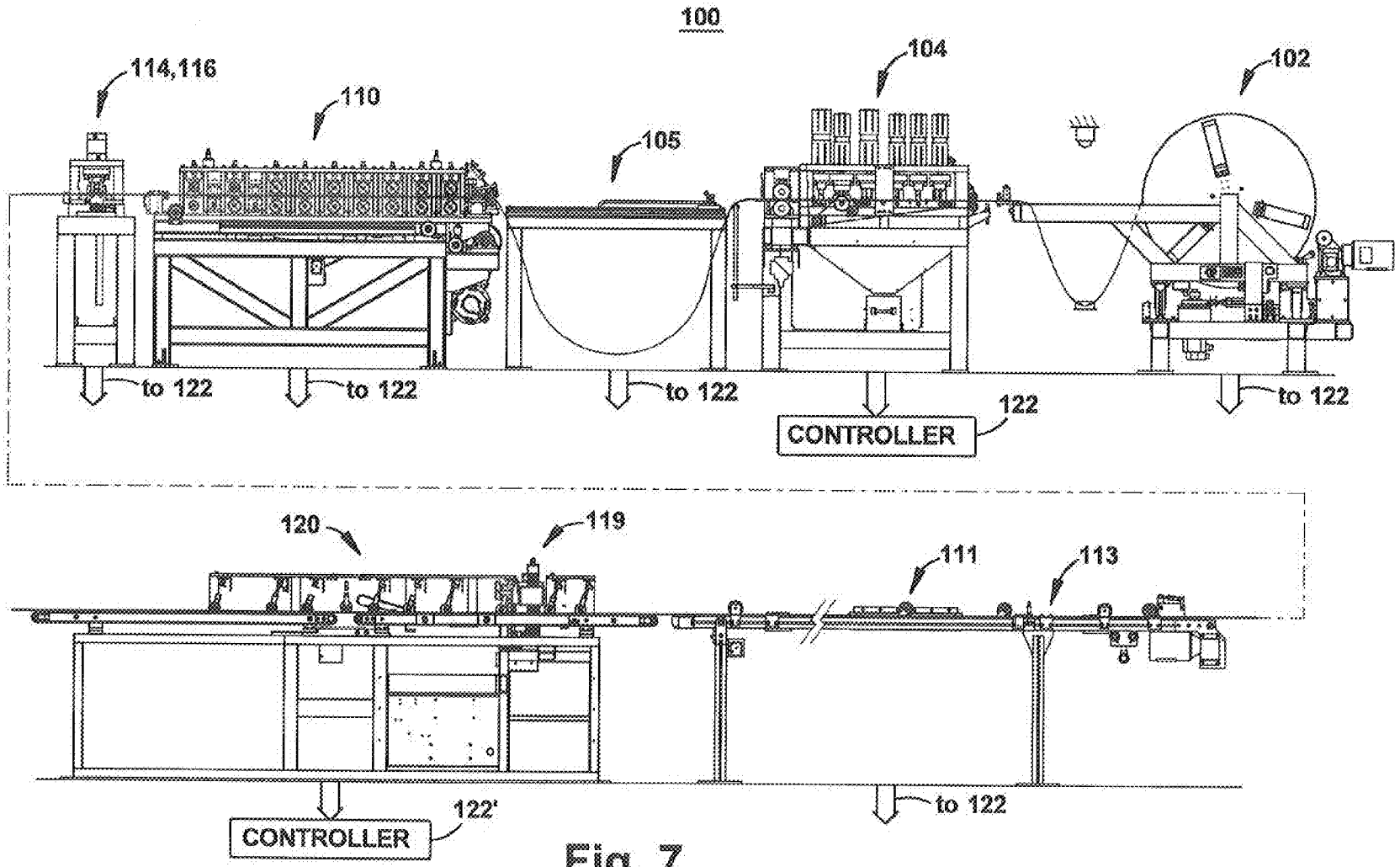
FIG. 7 is an elevational view of a spacer assembly production line constructed according to the invention.

As indicated previously the spacer assemblies 12 and muntin bars 130 are elongated window components 8 that may be fabricated by using the method and apparatus of the present invention. Elongated window components are formed at high rates of production. The operation by which elongated window components are fashioned is schematically illustrated by FIG. 7 as a production line 100 through which a thin, relatively narrow ribbon of sheet metal stock is fed endwise from a coil into one end of the assembly line and substantially completed elongated window components 8 emerge from the other end of the line 100.

The line 100 comprises a stock supply station 102, a first forming station 104, a transfer mechanism 105, a second forming station 110, a conveyor 113, a scrap removal apparatus 111, third and fourth forming stations 114, 116, respectively, where partially formed spacer, members are separated from the leading end of the stock and frame corner locations are deformed preparatory to being folded into their final configurations, a desiccant application station 119 where desiccant is applied to an interior region of the spacer frame member, and an extrusion station 120 where sealant is applied to the yet to be folded frame member. A scheduler/motion controller unit 122 (FIG. 7) interacts with the stations and loop feed sensors to govern the spacer stock size, spacer assembly size, the stock feeding speeds in the line, and other parameters involved in production. A preferred controller unit 122 is commercially available from Delta Tau, 21314 Lassen St, Chatsworth, Calif. 91311 as part number UMAC.

Desiccant Station 119

The desiccant application station 119 is controlled by the controller 122 for dispensing of a desiccant 22 into an interior region of an elongated window spacer 16. The system automatically selects an appropriate desiccant dispensing nozzle and/or automatically determines an appropriate distance D between the desiccant dispensing nozzle and the elongated spacer frame member 16 based on a property of the spacer frame member 16, such as a width W of the spacer frame member. The station 119 applies desiccant 22 to the interior region of the elongated window spacer 16. The desiccant 22 applied to the interior region of the elongated window spacer 16 captures any moisture that is trapped within an assembled insulating glass unit. Details of one acceptable desiccant application station 119 are disclosed in U.S. patent application Ser. No. 10/922,745, filed on Aug. 20, 2004 and assigned to the assignee of the present application. U.S. patent application Ser. No. 10/922,745 is incorporated herein by reference in its entirety.

Figure 8:
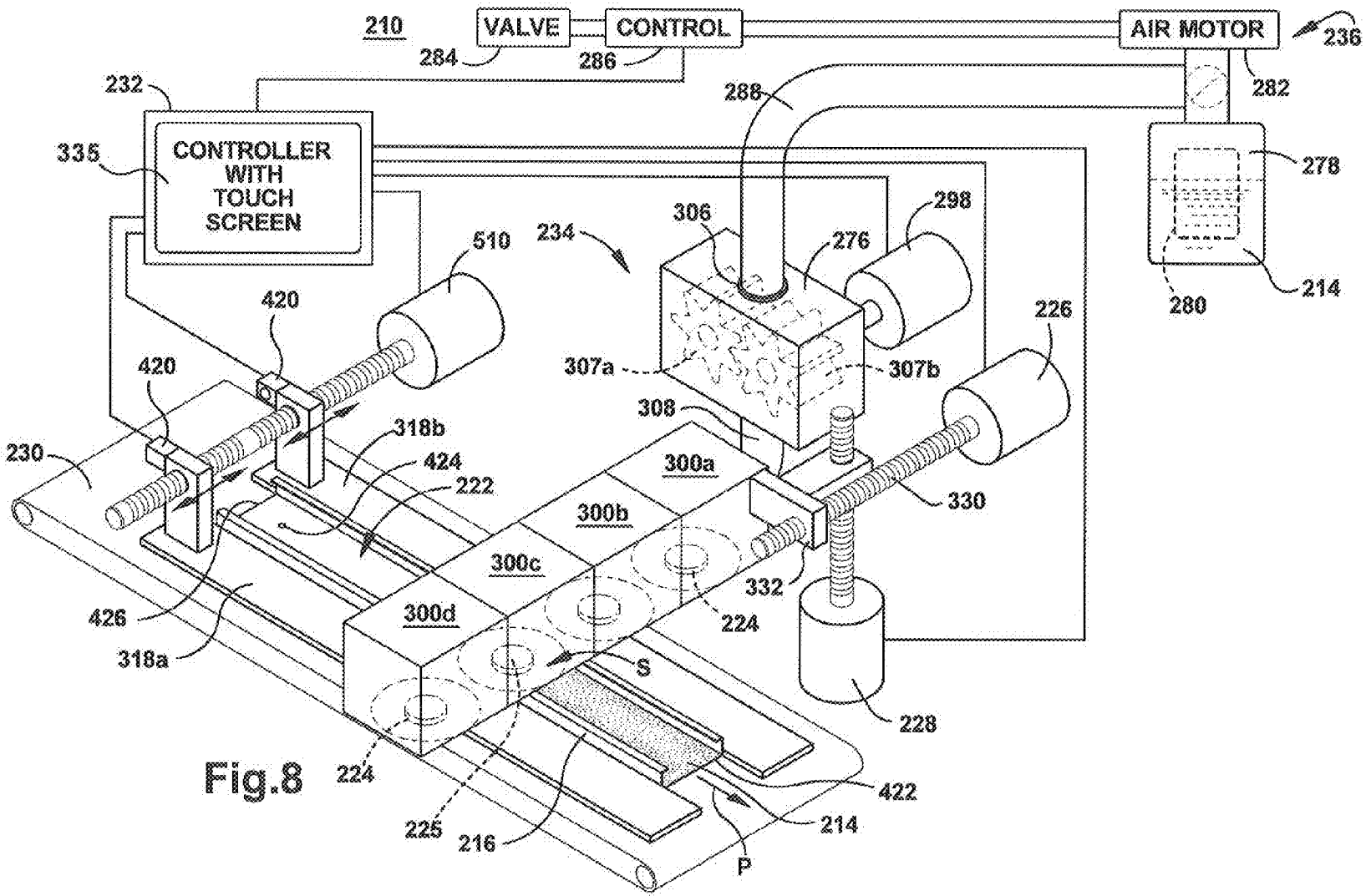
FIG. 8 is a schematic representation of a system for applying desiccant to elongated spacer frame members used in constructing insulating glass units.
Figure 9:
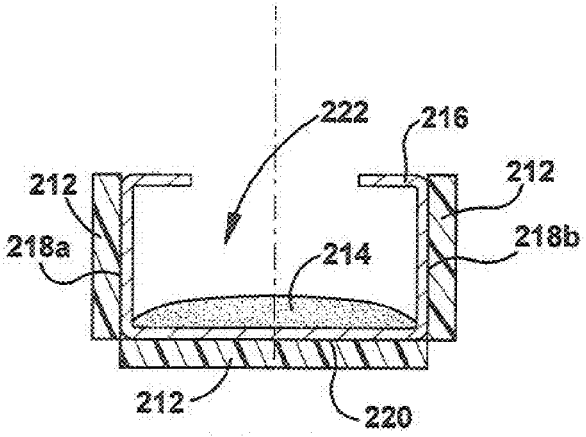
FIG. 9 is a front elevational view of an elongated spacer member with adhesive and desiccant applied to it.

FIG. 8 schematically illustrates a system 210 for controlled dispensing of a desiccant 214 into an interior region 222 of elongated window spacer 216. The system automatically selects an appropriate desiccant dispensing nozzle 224 and/or automatically determines an appropriate distance D (FIGS. 13 and 14) between the desiccant dispensing nozzle 224 and the elongated spacer frame member 216 based on a property of the spacer frame member 216, such as a width W of the spacer frame member. The system 210 applies desiccant 214 to the interior region 222 of the elongated window spacer 216. Adhesive 212 is also applied on the glass abutting walls **218*a*, 218*b* to facilitate attachment of glass lites (FIGS. 9 and 15) of an assembled insulated glass unit. Adhesive 212 on the outer wall 220 (FIG. 9) strengthens the elongated window spacer 216 and allows for attachment of external structure. The desiccant 214 applied to the interior region 222 of the elongated window spacer 216** captures any moisture that is trapped within an assembled insulating glass unit.

The system illustrated by FIG. 8 includes a plurality of nozzles 224, a nozzle indexing actuator 226, a nozzle height adjusting actuator 228, a conveyor 230, and a controller 232. An indexed nozzle 225 positioned above a path of travel P selectively opens to dispense the desiccant material 214 into the interior region 222 of the elongated spacer frame member. The remainder of the nozzles remain closed when the indexed nozzle 225 is dispensing desiccant. The nozzle indexing actuator 226 selectively indexes each of the nozzles 224 to a delivery site S located along the path of travel of the elongated spacer frame member. The nozzle height adjusting actuator 228 positions the nozzle above the conveyor at the delivery site. The conveyor 230 moves the elongated spacer frame member 216 along the path of travel relative to the delivery site at a controlled speed. The controller 232 monitors widths W (FIGS. 13 and 14) of elongated spacer frame members conveyed to the delivery site. The controller selects the indexed nozzle 225 based on the width W of an elongated spacer frame member 216 conveyed to the delivery site S. The conveyor also determines the appropriate distance D between the nozzle and the elongated spacer frame member 216 at the delivery site based on the width W of an elongated spacer frame member conveyed to the delivery site. Details of one acceptable controller 232 are described in U.S. Pat. No. 6,630,028 to Briese et al., which is incorporated herein by reference in its entirety.

In the embodiment illustrated by FIG. 8, the system 210 includes a desiccant metering and dispensing assembly 234, a desiccant bulk supply 236, the conveyor 230 and the controller 232. The desiccant bulk supply 236 supplies desiccant 214 under pressure to the desiccant metering and dispensing assembly 234. The desiccant metering and dispensing assembly 234 monitors pressure of the desiccant 214 supplied by the desiccant bulk supply 236. The controller 232 regulates the pressure of the desiccant 214 delivered to the desiccant metering and dispensing assembly 234 based on the pressures sensed by the desiccant metering and dispensing assembly 234. The conveyor 230 moves the elongated window spacer 216 past the desiccant metering and dispensing assembly 234 at a rate of speed controlled by the controller 232.

In the exemplary embodiment, the desiccant metering and dispensing assembly 234 includes a desiccant metering pump 276 which is a gear pump in the exemplary embodiment. The speed of the desiccant dispensing gear pump 276 is controlled to dispense the desired amount of desiccant through the indexed nozzle 225 to the interior region 222 of the elongated spacer member 216. The desiccant metering and dispensing assembly 234 dispenses the desired amount of desiccant 214 into the interior region 222 of the elongated window spacer 216 as the elongated window spacer 216 is moved past the desiccant metering and dispensing assembly 234 by the conveyor 230.

Referring to FIG. 8, the desiccant bulk supply 236 includes a desiccant reservoir 278 filled with desiccant 214, a shovel pump mechanism 280, an air motor 282, an exhaust valve 284, an electropneumatic regulator 286, and a hose 288. One acceptable shovel pump mechanism for desiccant is model no. MHMP41042SP, manufactured by Glass Equipment Development. The desiccant electropneumatic regulator 286 regulates the pressure applied to the desiccant 214 by the desiccant air motor 282. One acceptable electropneumatic regulator 286 is model no. QB1TFEE100S560-RQ00LD, produced by Proportion-Air. The hose 288 extends from an outlet of the shovel pump mechanism 280 to an inlet 306 of the desiccant gear pump 276. In the exemplary embodiment, the desiccant reservoir 278 is a 55 gallon drum filled with desiccant 214. In one embodiment, the desiccant is heated before it is applied. One acceptable heated desiccant is HL-5157, produced by H. B. Fuller. In a second embodiment, the desiccant is applied cold (i.e., at room temperature). One acceptable cold desiccant is PRC-525 made by PRC-525-DM. The shovel pump mechanism 280 delivers desiccant 214 under pressure to the hose 288. In the exemplary embodiment, the shovel pump mechanism 280 heats the desiccant 214 to condition it for application by the desiccant metering and dispensing assembly 234. To stop additional pressure from being applied to the desiccant 214, the exhaust valve 284 is selectively opened. One acceptable desiccant shovel pump 280 for supplying heated desiccant is model no. MHMP41024SP, produced by Glass Equipment Development. One acceptable pump 280 for supplying cold desiccant is model no. MCFP1031SP, produced by Glass Equipment Development.

Most manufacturing facilities generate approximately 100 psi of air pressure. The piston diameter ratio of the desiccant shovel pump mechanism 280 amplifies the air pressure provided by the manufacturing facility by a factor of 42 to 1. Magnification of the air pressure provided by the facility enables the shovel pump mechanism 280 to supply desiccant 214 at a maximum pressure of 4200 psi to the desiccant hose 288.

In one embodiment, when heated material is used, the desiccant hose 288 is a 1 inch diameter insulated hose and is approximately 10 feet long. In another embodiment, when cold desiccant is used a 1 inch diameter non-insulated hose is used. The pressure of the desiccant 214 as it passes through the hose 288 will drop approximately 1000 psi as it passes through the hose 288, resulting in a maximum desiccant pressure of 3200 psi at the inlet 306 of the adhesive metering and dispensing assembly 234.

In the embodiment illustrated by FIGS. 8, 20-25 and 26, the desiccant metering and dispensing assembly 234 includes a desiccant gear pump 276, a desiccant gear pump motor 298, and a plurality of desiccant dispensing guns 300 in series. Referring to FIG. 8, desiccant 214 is supplied under pressure by the desiccant bulk supply 236 via the hose 288 to the inlet 306 of the desiccant gear pump 276. Controlled rotation of pump gears 307*a*, 307*b* by the desiccant gear pump motor 298 meters and supplies desiccant 214 to the line of desiccant dispensing guns 300 through a desiccant gear pump outlet 308.

In the exemplary embodiment, the desiccant dispensing guns 300 are snuff-back valve-type dispensing guns that utilizes an air cylinder to apply an upward force on a stem that extends to a nozzle 224 when the needle valve is closed. To dispense desiccant 214, a solenoid valve of the indexed dispensing gun 300 causes the air cylinder 310 to move the desiccant stem 312 away from the air cylinder and a sealing seat of the indexed nozzle 225, allowing desiccant 214 to flow through an open orifice of the nozzle indexed 225. The remainder of the dispensing guns 300 remain closed. As such, desiccant is dispensed only through the indexed nozzle 225. In the embodiment illustrated by FIG. 8, an inlet of a first dispensing gun 300*a* is provided with desiccant by an outlet of the metering pump 276, an inlet of a second dispensing gun 300*b* is provided with desiccant by an outlet of the first dispensing gun 300*a*, an inlet of a third dispensing gun 300*c* is provided with desiccant by an outlet of the second dispensing gun 300*b*, and an inlet of a fourth dispensing gun 300*d* is provided with desiccant by an outlet of the third dispensing gun 300*c*. It should be readily apparent that any number of dispensing guns could be included in the desiccant metering and dispensing assembly. One suitable desiccant dispensing gun 300 is model no. 2-15266, manufactured by Glass Equipment Development.

Figure 17A:
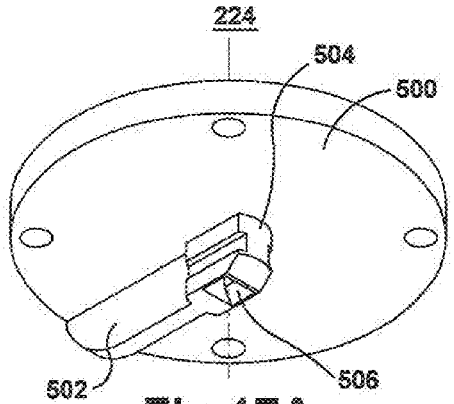
FIG. 17A is a perspective view of a nozzle.
Figure 17B:
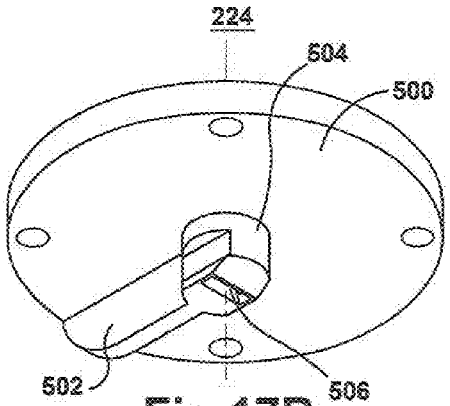
FIG. 17B is a perspective view of a nozzle.

In the exemplary embodiment, each nozzle 224 can be used to deliver desiccant to a range of elongated spacer frame widths. For example, a first nozzle may be sized to apply desiccant to elongated spacer members having widths ranging from 11/32" to 13/32". A second nozzle may be sized to apply desiccant to elongated spacer members having widths ranging from ½" to 19/32". A third nozzle may be sized to apply desiccant to elongated spacer members having widths ranging from 19/32" to 21/32". FIGS. 17A and 17B illustrate two differently sized nozzles 224. The nozzles illustrated in FIGS. 17A and 17B are single integral members that each include a mounting plate 500, a guide pin 502, and a dispensing tip 504. The mounting plate 500 facilitates attachment to a dispensing gun. The guide pin 502 inhibits significant misalignment of elongated spacer frame members with respect to the nozzle 224. The dispensing tip 504 includes an orifice 506 through which the desiccant is dispensed.

Referring to FIGS. 17A and 17B, the system 210 includes a variety of differently sized nozzles 224 to accommodate spacers having various widths. For example, the system may include six nozzles to accommodate spacers having widths ranging from 7/32" to ⅞". In the exemplary embodiment, the system monitors the widths W of elongated spacer frame members approaching the delivery site. The width may be monitored in a variety of ways. For example, a schedule may be imported to the controller that includes the widths of each of the elongated spacer frame members that will be processed by the system, the width of the approaching spacer may be provided by a machine that forms the elongated spacer frames, and/or the widths of approaching spacer frame members may be measured. Once the width of the approaching elongated spacer frame member or group of elongated spacer frame members is known, the appropriate nozzle is automatically indexed to the delivery site based on the monitored width of the approaching spacer frame member(s). For example, a nozzle that accommodates ½" to 19/32" wide elongated spacer frame members would automatically be indexed to the delivery site when the system 210 determines that a 9/16" wide spacer frame is approaching the delivery site.

Figure 11:
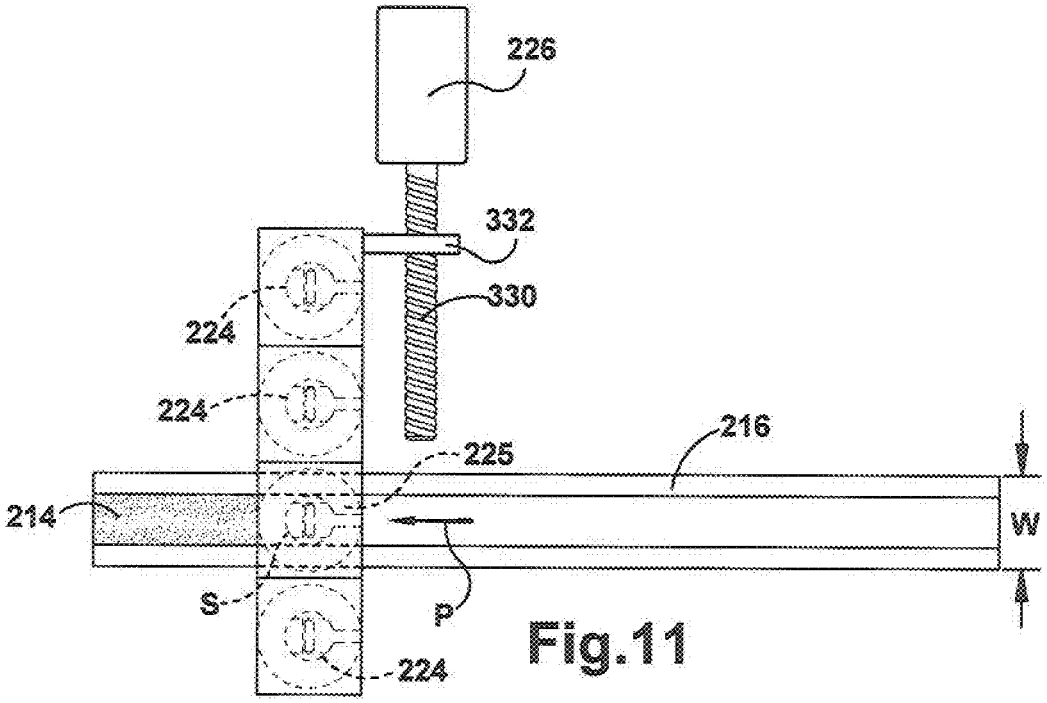
FIG. 11 is a schematic illustration of a plurality of indexable nozzles positioned above an elongated spacer frame member having a first width.
Figure 12:
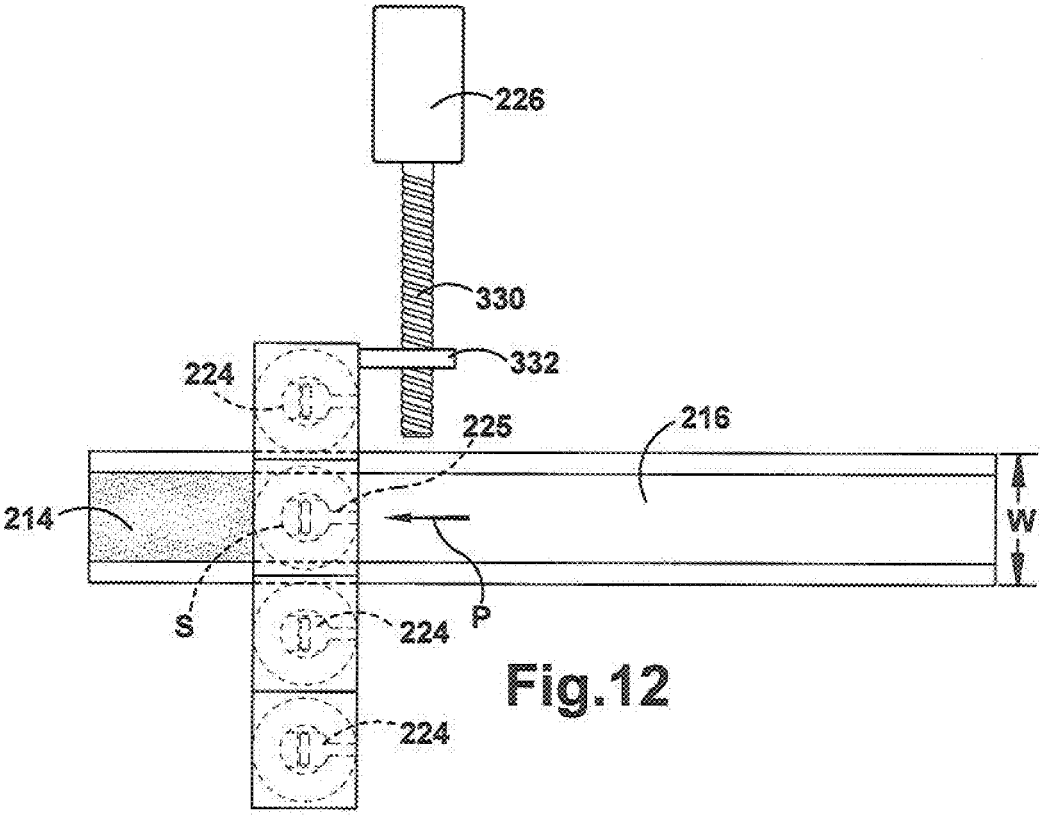
FIG. 12 is a schematic illustration of a plurality of indexable nozzles positioned above an elongated spacer frame member having a second width.

Referring to FIGS. 11 and 12, the nozzles 224 are indexed by the nozzle indexing actuator 226 that is controlled by the controller. In the illustrated embodiment, the nozzle indexing actuator 226 is a motor. The nozzle indexing actuator 226 drives an externally threaded shaft 330 that is coupled to a plate 332. The plate 332 is connected to the nozzles 224, such that rotation of the shaft 330 by the nozzle indexing actuator 226 linearly moves the plate 332 and nozzles 224. In FIG. 11 the indexed nozzle 225 corresponds to the width of the elongated spacer frame illustrated in FIG. 11. When the width of the elongated spacer frame member 216 shown in FIG. 12 is sensed, the nozzle indexing actuator 226 rotates the shaft 330 to index the nozzle that corresponds to the width of the elongated spacer frame illustrated in FIG. 12 to the delivery site.

In the embodiment illustrated by FIGS. 20-28, the dispensing guns 300, the desiccant metering pump 276, and the desiccant pump motor 298 are mounted to a carriage 334. The carriage 334 is mounted to a rail 336 such that the carriage is laterally moveable with respect to the rail. The plate 332 is fixed to the carriage 334. The nozzle indexing actuator 226 and a bearing plate 338 (FIGS. 22 and 23) are fixed with respect to the rail 336. The threaded shaft 330 extends from the nozzle indexing actuator 226, through the plate 332, and is supported by a bearing 340 mounted in the bearing plate 338. Rotation of the threaded shaft 330 linearly moves the plate 332 and carriage 334 along the rail. The carriage linearly moves the dispensing guns 300, the desiccant metering pump 276, and the desiccant pump motor 298 as a unit to index the appropriate nozzle 224 to the delivery site.

Figure 18:
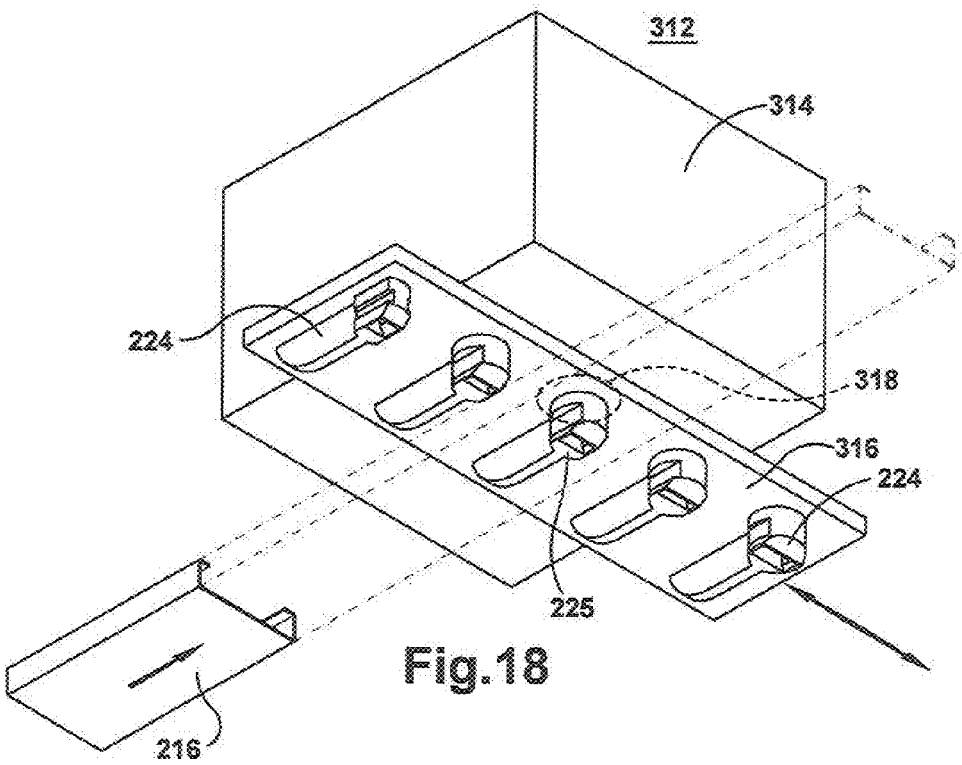
FIG. 18 illustrates a plurality of nozzles carried by a nozzle carrying plate.

FIG. 18 illustrates a dispensing gun 312 of an alternate embodiment. The dispensing gun includes a single valve assembly 314, and a plurality of nozzles 224 carried by an indexable nozzle carrying plate 316. The valve assembly 314 selectively dispenses desiccant 214 through an opening 318 that is positioned above the desiccant delivery site. The nozzle carrying plate 316 can be linearly moved to position each of the nozzles over the opening 318 at the delivery site. Once the appropriate nozzle 224 is positioned at the delivery site, the valve assembly 314 is controlled to dispense desiccant through the opening 318 and through the indexed nozzle 225 to the delivery site.

Figure 19:
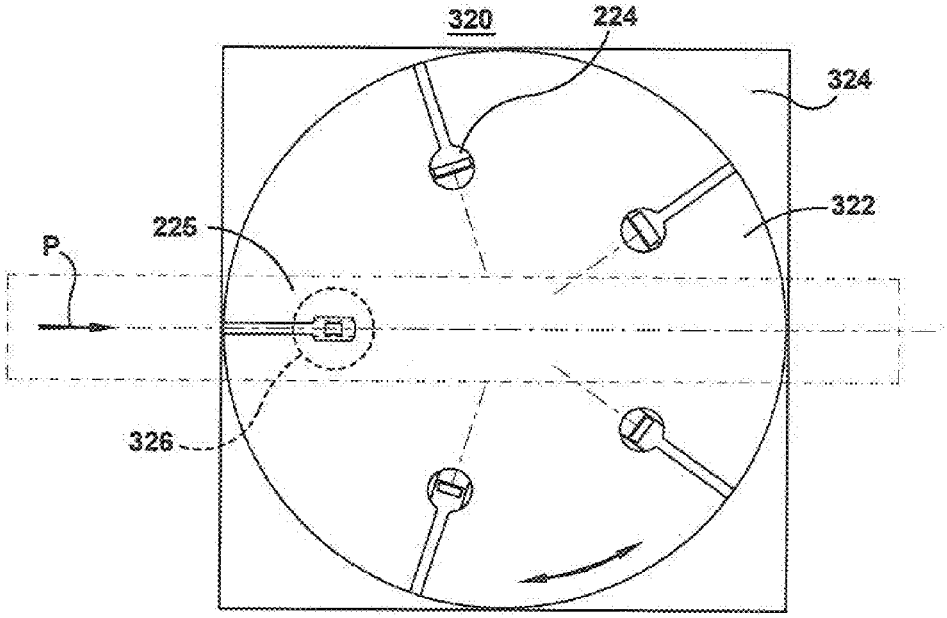
FIG. 19 illustrates a plurality of nozzles carried by a turret.

FIG. 19 illustrates a dispensing gun 320 of an alternate embodiment. The dispensing gun includes a single valve assembly 324, and a plurality of nozzles 224 carried by an indexable turret manifold 322. The valve assembly 324 selectively dispenses desiccant 214 through an opening 326 that is positioned above the desiccant delivery site. The turret can be rotated to position each of the nozzles over the opening 326 at the delivery site. Once the appropriate nozzle 224 is positioned at the delivery site, the valve assembly 324 is controlled to dispense desiccant through the indexed nozzle 225 to the delivery site. In the exemplary embodiment, the nozzles are arranged on the turret 322 such that only one nozzle is positioned in the path P of travel of the elongated window spacers 216 at a time.

In the exemplary embodiment, each nozzle 224 can be used to deliver desiccant to a range of elongated spacer frame widths. For example, a first nozzle may be sized to apply desiccant to elongated spacer members having widths ranging from 11/32" to 13/32". A second nozzle may be sized to apply desiccant to elongated spacer members having widths ranging from ½" to 19/32". A third nozzle may be sized to apply desiccant to elongated spacer members having widths ranging from 19/32" to 21/32".

Figure 13:
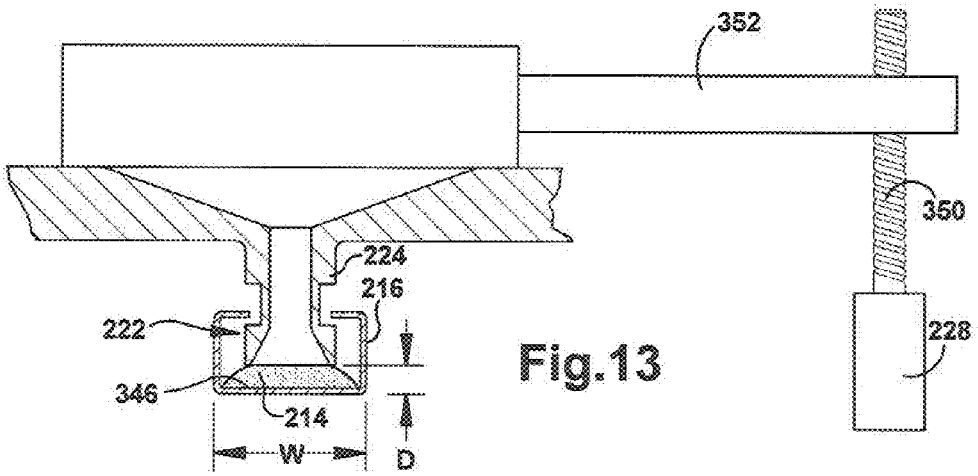
FIG. 13 is a schematic illustration of a nozzle positioned at a first height with respect to an elongated spacer frame member.
Figure 14:
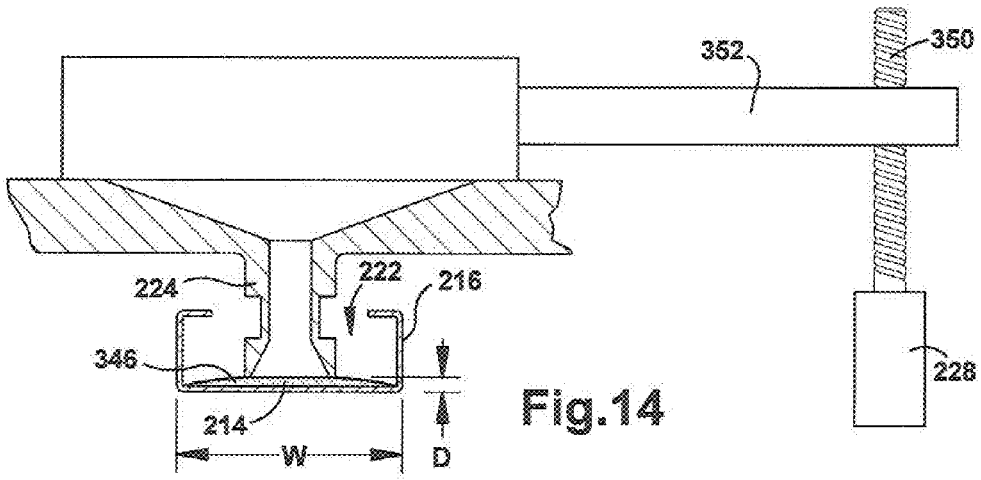
FIG. 14 is a schematic illustration of a nozzle positioned at a second height with respect to an elongated spacer frame member.

Referring to FIGS. 13 and 14, the height of the indexed nozzle 225 is vertically adjusted with respect to the path of travel based the width W of an elongated spacer frame member approaching the delivery site. In the exemplary embodiment, the width of the elongated spacer frame member approaching the delivery site is monitored and the indexed nozzle 225 is automatically vertically adjusted with respect to the elongated spacer frame member to a distance D above the spacer frame member that corresponds to the width of the spacer frame member. As is illustrated by FIGS. 13 and 14, by adjusting the relative distance between the spacer frame member and the nozzle at the delivery site, the width of the desiccant material applied by the nozzle to the elongated spacer frame member is adjusted.

Referring to FIGS. 13 and 14, the nozzles 224 are vertically positioned by a nozzle height adjusting actuator 228 that is controlled by the controller. In the exemplary embodiment, the nozzle height adjusting actuator 228 is a motor. The nozzle height adjusting actuator 228 drives an externally threaded shaft 350 that is coupled to a plate 352. The plate 352 is connected to the nozzles 224, such that rotation of the shaft 350 by the nozzle height adjusting actuator 228 linearly moves the plate 352 and nozzles 224. In FIG. 13 the vertical position corresponds to the width of the elongated spacer frame illustrated in FIG. 13. When the width of the elongated spacer frame member 216 shown in FIG. 14 is sensed, the nozzle height adjusting actuator 228 rotates the shaft 350 to move the indexed nozzle 225 to a height that corresponds to the width of the elongated spacer frame illustrated in FIG. 14 to the delivery site.

In the embodiment illustrated by FIGS. 20-28, lateral rail 336 that supports lateral carriage 334 carrying the dispensing guns 300, the desiccant metering pump 276, and the desiccant pump motor 298 is mounted to a vertical carriage 354. The carriage 354 is mounted to a pair of rails 356 such that the carriage is vertically moveable with respect to the rails 356. The plate 352 is fixed to the vertical carriage 354. The nozzle height adjusting actuator 228 is fixed with respect to the pair of rails 356. The threaded shaft 350 extends from the vertically adjusting nozzle height adjusting actuator 228 through the plate 352. Rotation of the threaded shaft 350 linearly moves the plate 352 and carriage 354 along the pair of rails. The carriage vertically moves the dispensing guns 300, the desiccant metering pump 276, and the desiccant pump motor 298 to appropriately position the indexed nozzle above the delivery site for the approaching elongated spacer frame member(s).

Figure 15:
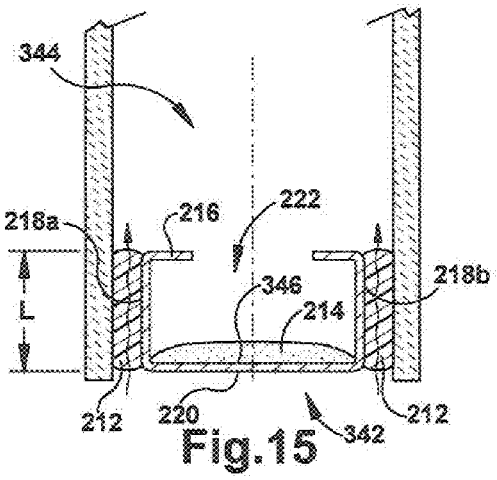
FIG. 15 illustrates an insulating glass unit having a first width.
Figure 16:
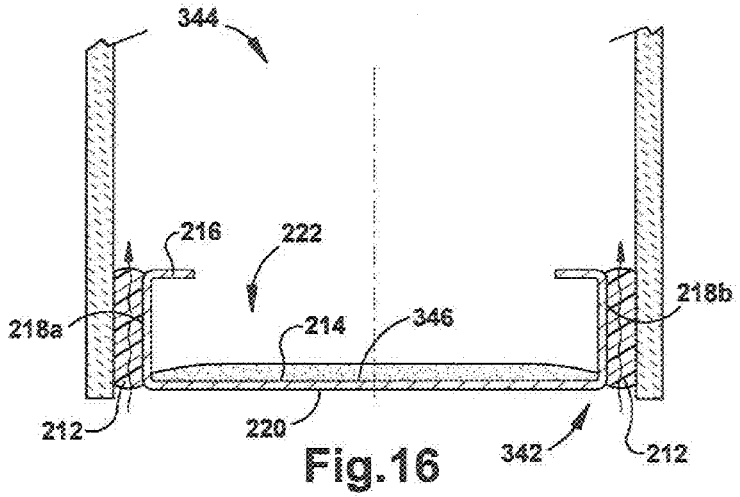
FIG. 16 illustrates an insulating glass unit having a second width.

In one embodiment, the volume of desiccant material per unit of spacer frame member length applied by a nozzle 225 is based on a moisture vapor transfer rate of an insulated glass unit constructed with the elongated spacer frame member. Referring to FIGS. 15 and 16, the moisture vapor transfer rate is dependant on the length L of the path from the exterior 342 to the interior 344 of the insulating glass unit. In the example illustrated by FIGS. 15 and 16, this length L is dictated by the width of the adhesive 212 applied to the side walls 218*a*, 218*b*. This length L may be approximately the same for insulating glass units with different spacer frame widths. As a result, the volume of desiccant material per unit of spacer frame member length can be constant for a range of spacer frame widths. In the example illustrated by FIGS. 15 and 16, the length L of the path from the exterior 342 to the interior 344 is approximately the same for wider spacer frame member illustrated by FIG. 16 as the narrower spacer frame member illustrated by FIG. 15. As a result, approximately the same amount of desiccant 214 can be used in the insulating glass unit illustrated by FIG. 16 as the insulating glass unit illustrated by FIG. 15. The height of the indexed nozzle 225 can be adjusted as illustrated by FIGS. 13 and 14 to adjust the width of the bead of desiccant applied to the elongated spacer members. In the example of FIGS. 13 and 14, the indexed nozzle 225 is moved closer to the spacer frame member, such that the same volume of desiccant material per unit length applied in the narrower spacer frame member of FIG. 13 is spread out to cover the entire interior wall 346 of the wider spacer frame member of FIG. 14. The application of the same volume of desiccant material per unit length to cover the entire interior wall a wider spacer can also be accomplished by indexing a larger nozzle to the delivery site.

The volume of desiccant 214 dispensed by the desiccant metering and dispensing assembly 234 can be precisely metered by controlling the speed of the gears 307*a*, 307*b* of the desiccant gear pump motor 298. As long as material is continuously supplied to the inlet of the desiccant gear pump 298, the same volume of desiccant is dispensed for each revolution of the gears 307*a*, 307*b*. In the exemplary embodiment, the desiccant metering and dispensing assembly 234 includes a manifold, which delivers the desiccant 214 from the hose 288 to the desiccant gear pump 276 and delivers the desiccant 214 from the desiccant gear pump 276 to the line of desiccant dispensing guns 300. A known amount of desiccant 214 is dispensed for every revolution of the desiccant gear pump 276. In the exemplary embodiment, the desiccant gear pump 276 provides 20 $cm^3$ of desiccant 214 per revolution of the desiccant gear pump 276.

Figure 20:
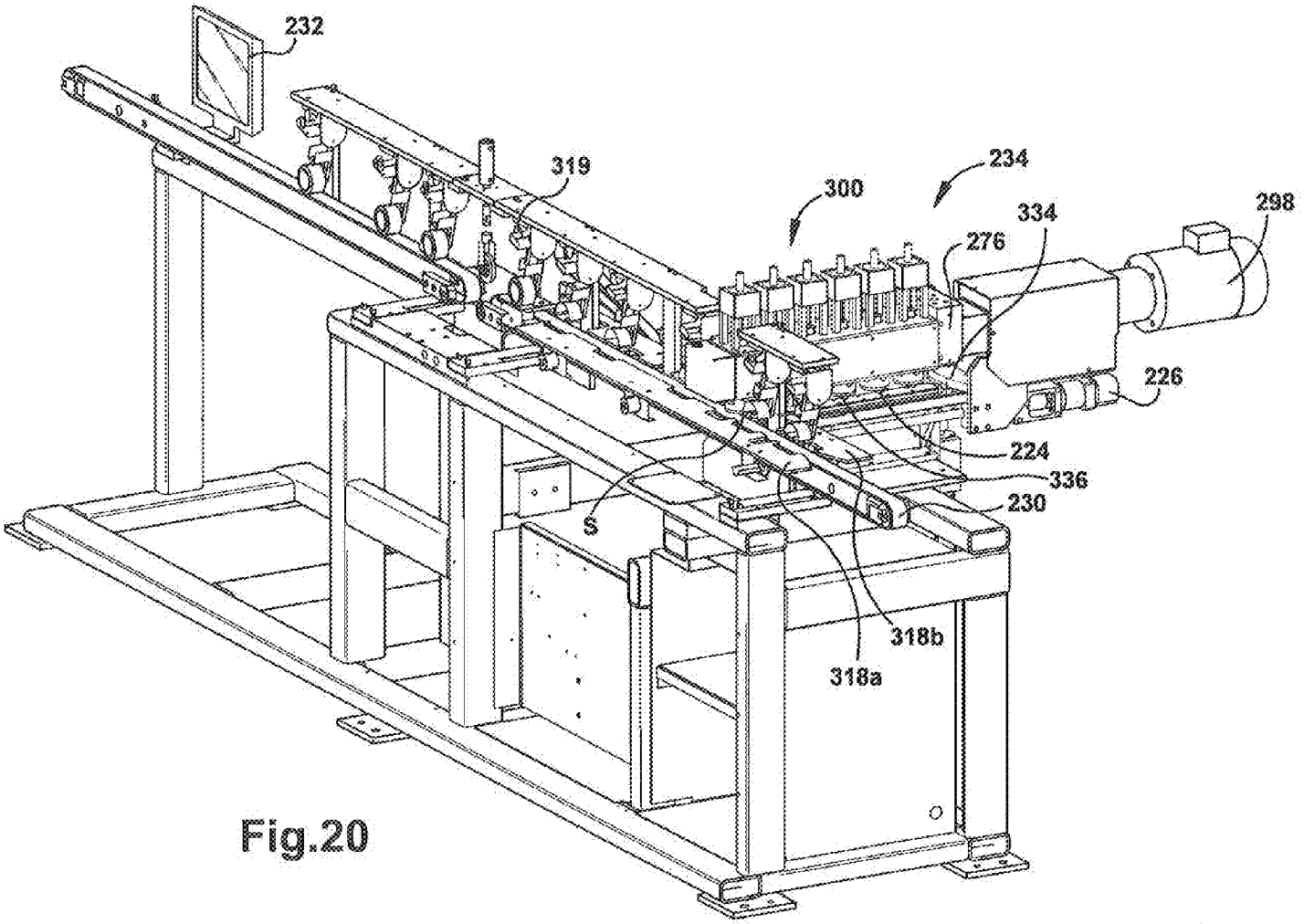
FIG. 20 is a perspective view of a system for controlled dispensing of desiccant.
Figure 21:
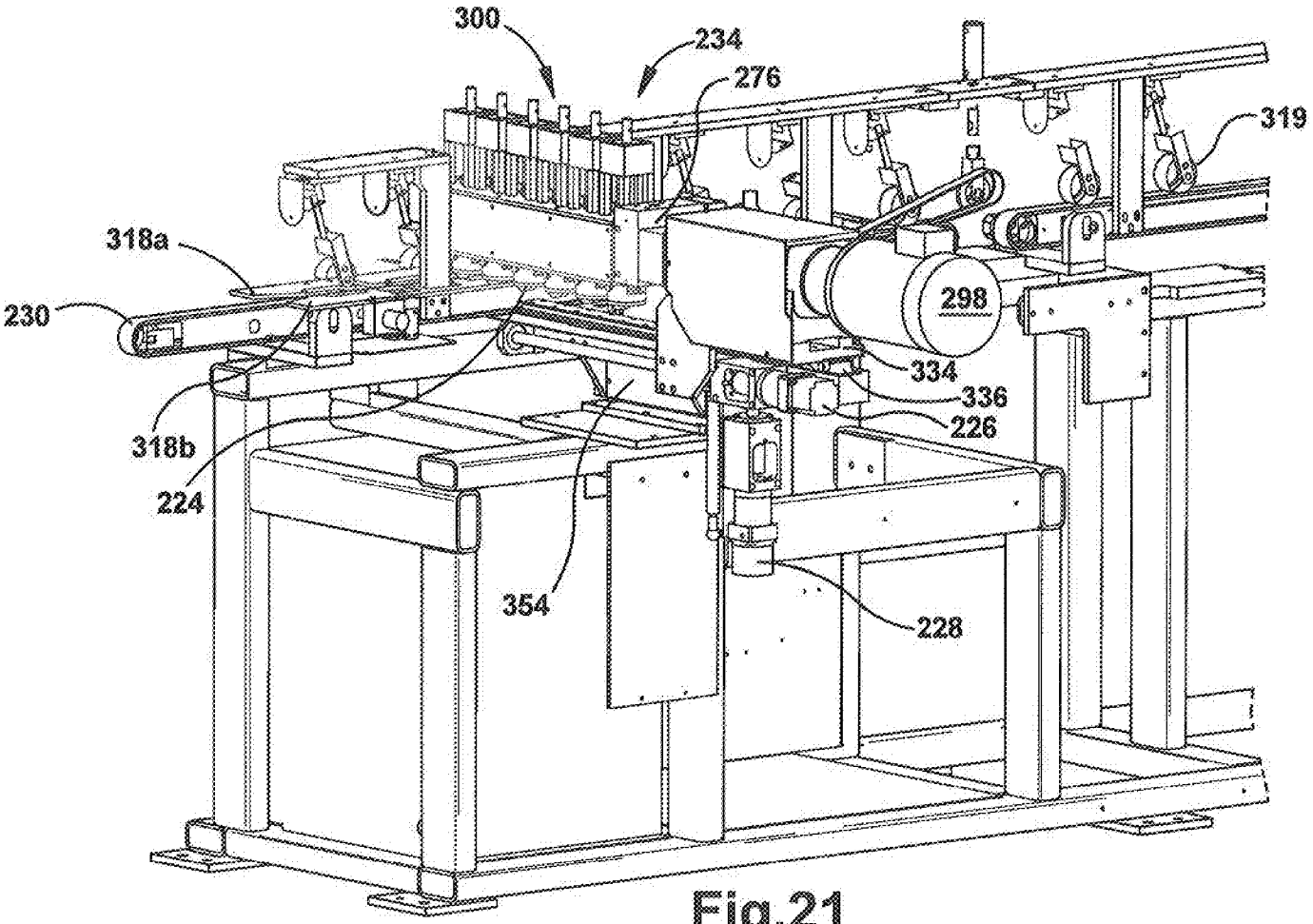
FIG. 21 is a perspective view of a system for controlled dispensing of desiccant.
Figure 22:
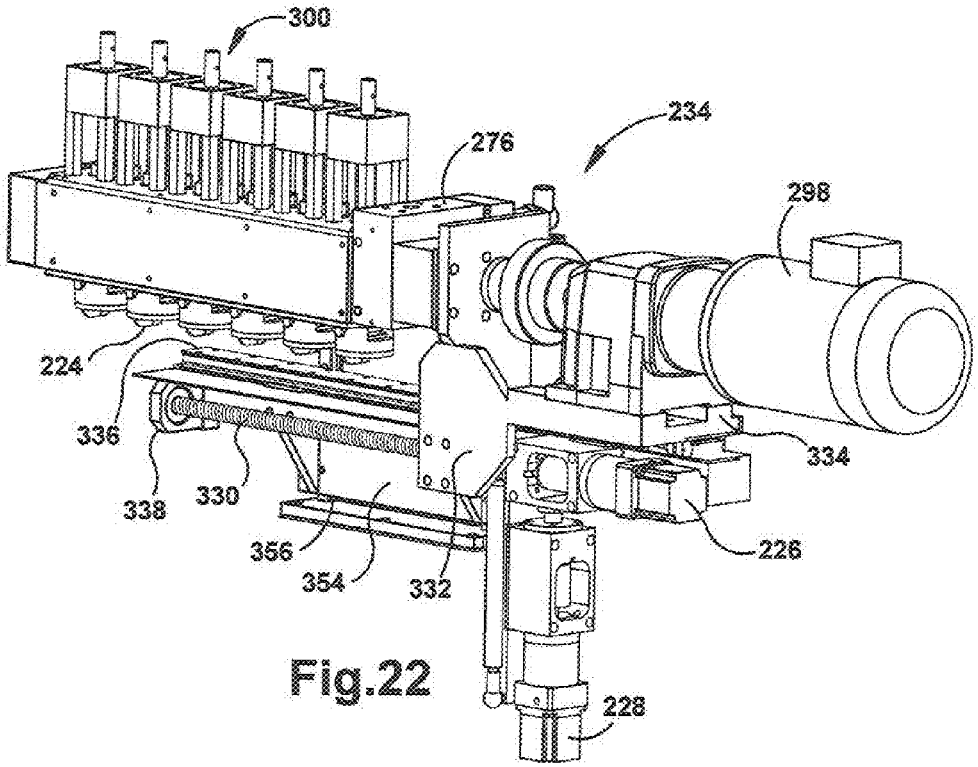
FIG. 22 is a perspective view of a multiple station desiccant dispensing assembly.
Figure 23:
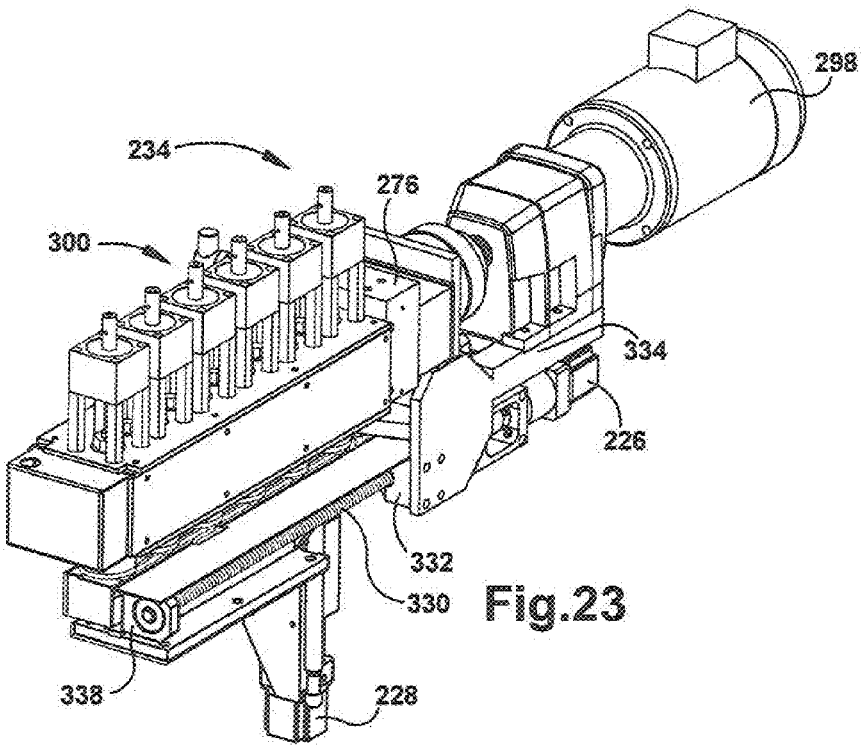
FIG. 23 is a perspective view of a multiple station desiccant dispensing assembly.
Figure 25:
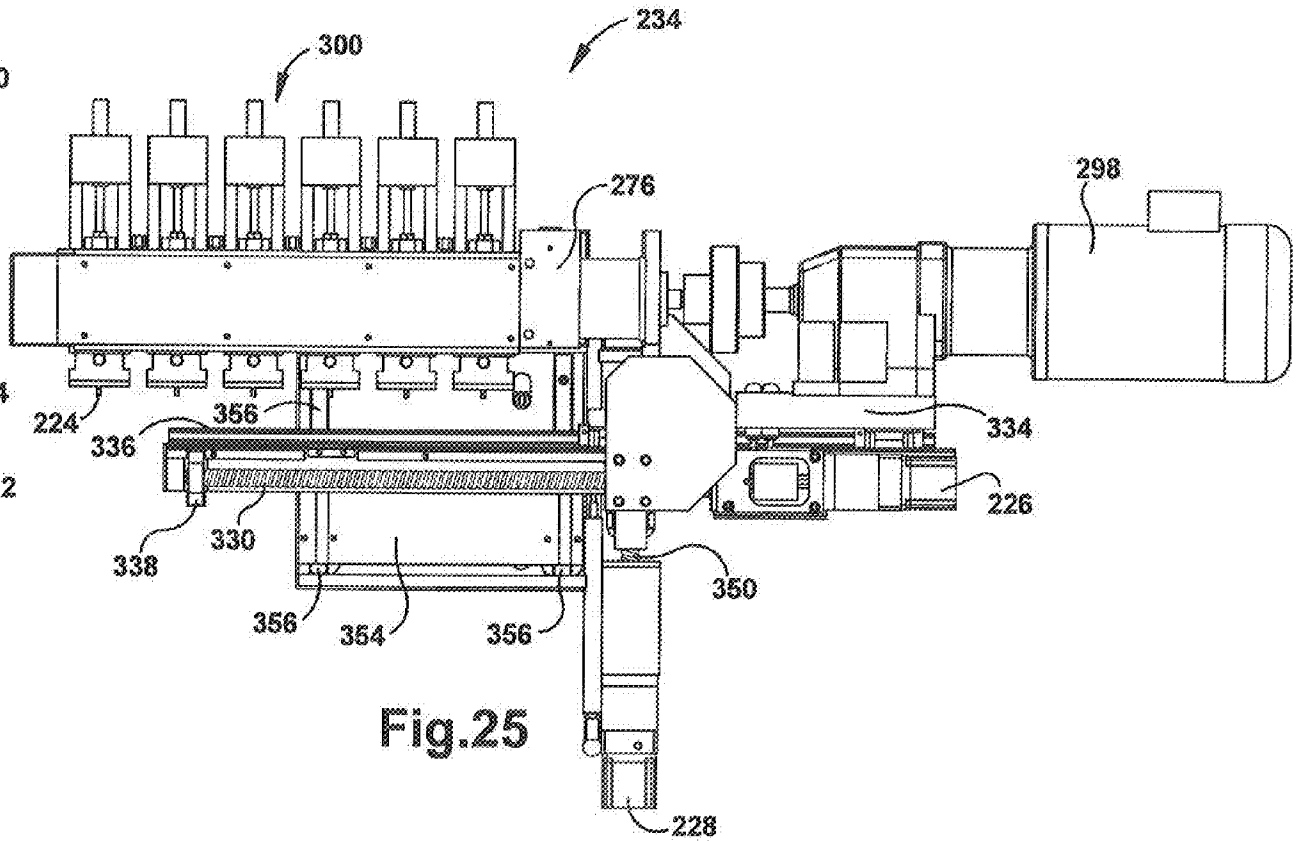
FIG. 25 is a side elevational view of a multiple station desiccant dispensing assembly.
Figure 24:
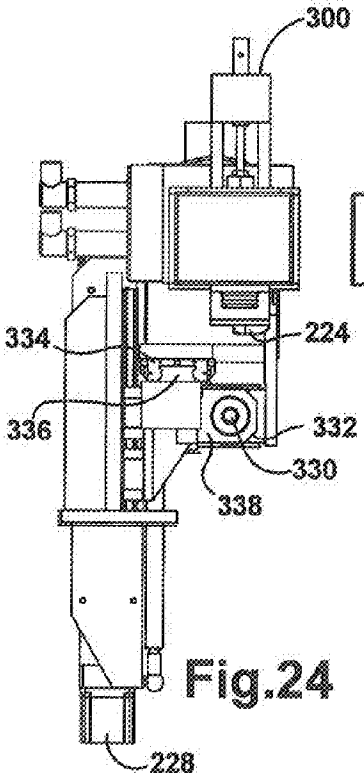
FIG. 24 is an end elevational view of a multiple station desiccant dispensing assembly.
Figure 26:
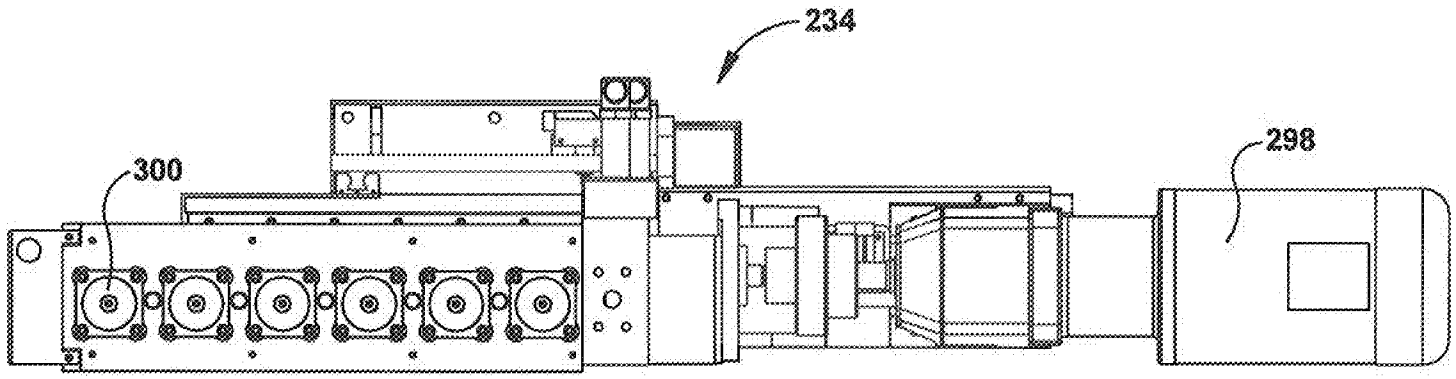
FIG. 26 is a plan view of a multiple station desiccant dispensing assembly.
Figure 27:
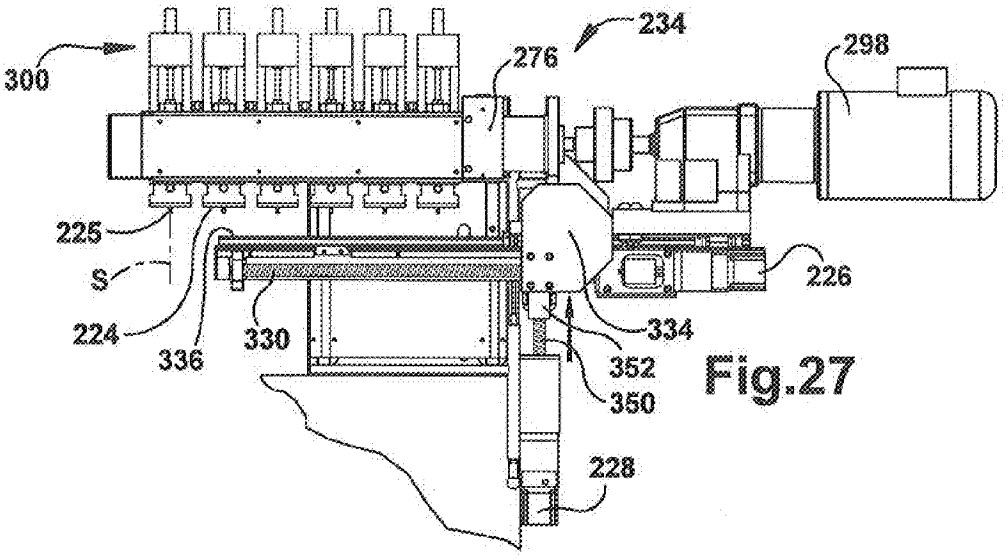
FIG. 27 is a side elevational view of a multiple station desiccant dispensing assembly.
Figure 28:
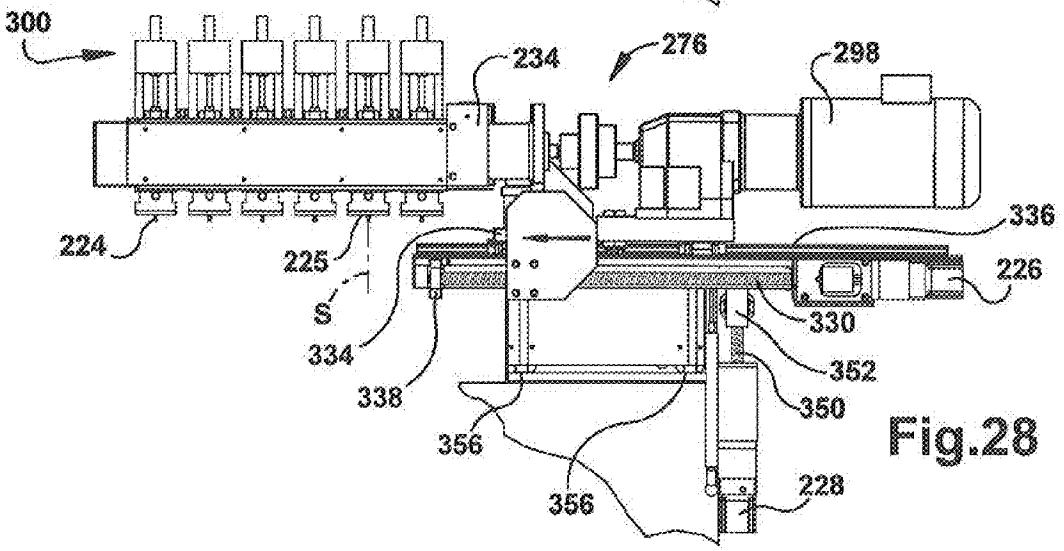
FIG. 28 is a side elevational view of a multiple station desiccant dispensing assembly.

Referring to FIGS. 8 and 20, the conveyor 230 moves elongated window spacers 216 past the desiccant metering and dispensing assembly 234. The desiccant metering and dispensing assembly 234 applies desiccant 214 to an interior region 222 of the elongated window spacer 216 as the conveyor 230 moves the elongated window spacer 216 beneath the indexed nozzle 225. The indexed desiccant dispensing gun 300 is located at the delivery site, directly above the conveyor 230, allowing desiccant 214 to be dispensed into the interior region 222 of the elongated window spacer 216 as the elongated window spacer moves past the indexed desiccant dispensing gun 300.

Referring to FIG. 8, the system 210 includes first and second conveyor guides 318*a*, 318*b* which guide the elongated window spacer 216 and position the window spacer in the center of the conveyor 230 as the elongated window spacer moves along the conveyor. The conveyor guides 318*a*, 318*b* are automatically moved toward and away from each other by a servo motor 510 (FIG. 8) based on the width of the approaching elongated spacer frame member(s). In the exemplary embodiment, the conveyor guides 318*a*, 318*b* are automatically adjust to accommodate spacers having widths ranging from 7/32" to 7/8". The system 210 illustrated in FIGS. 20 and 21 also includes rolling guides 319 (some removed to simplify drawing) that hold elongated spacers 216 firmly against the conveyor 230 as the spacer is moved along the conveyor. In the exemplary embodiment, the guides include wheels that are forced toward the conveyor by a spring loaded mechanism.

Figure 10:
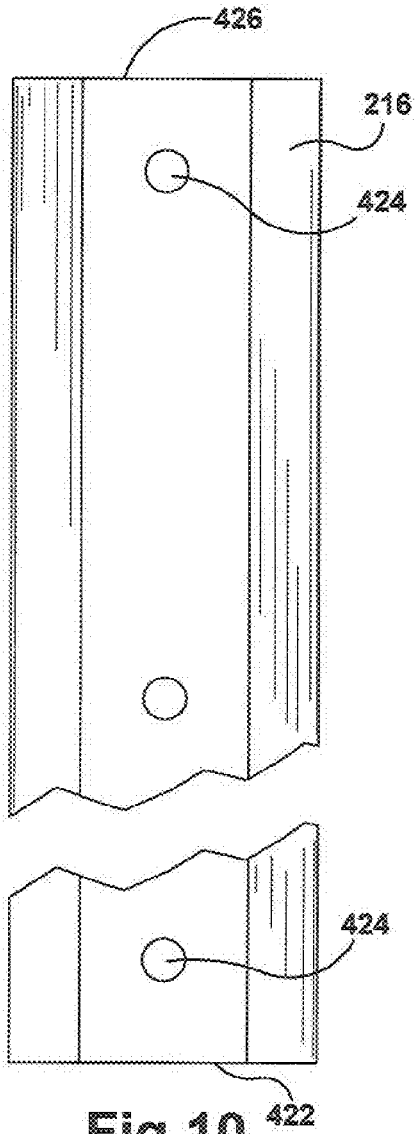
FIG. 10 is a top plan view of an elongated spacer frame member.

Referring to FIG. 8, a pair of desiccant fiber optic sensors 420 is shown mounted in relation to the conveyor 230 at a point along the path of the conveyor 230 before the delivery site. In the disclosed embodiment of the invention there are two desiccant fiber optic sensors. The desiccant fiber optic sensors sense a leading edge 422, gas holes 424 and a trailing edge 426 of an elongated window spacer 216 (see FIG. 10). The desiccant fiber optic sensors 420 provide a signal to the controller 232 when the sensor 420 senses a leading edge, a gas hole or the trailing edge of an elongated spacer 216. The controller 232 uses this signal to determine when the elongated spacer member 216 will pass under the nozzle 314 of the desiccant metering and dispensing assembly 226.

Figure 29:
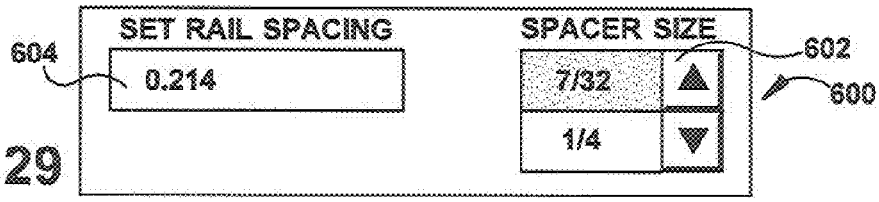
FIG. 29 is an illustration of a guide rail setup screen.

Referring to FIG. 8, the controller 232 includes a touch sensitive display 335 for both inputting parameters and displaying information. During a setup sequence, the user is prompted to enter a target conveyor speed, to enter the width between the guide rails 318*a*, 318*b* for each spacer frame width, to calibrate the vertical home position of the nozzles, to calibrate the horizontal home position of each nozzle, to enter the number of active desiccant nozzles, to assign a nozzle position to each spacer size, to assign an amount of desiccant per unit length for each spacer size, and to assign a nozzle height to each spacer size. FIG. 29 illustrates a rail spacing setup screen 600. A spacer size selection box 602 allows the user to select each spacer size. A rail spacing selection box 604 allows the user to set the desired rail spacing for the selected spacer size.

Figure 30:
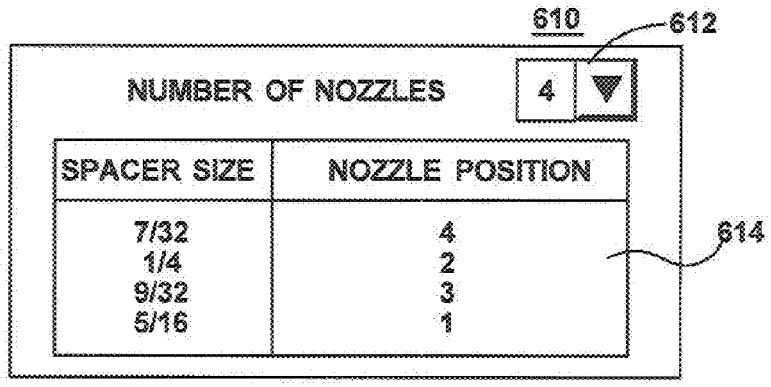
FIG. 30 is an illustration of a nozzle position setup screen.

FIG. 30 illustrates a nozzle position setup screen 610. A number of nozzles box 612 allows the user to select the number of active desiccant nozzles 224. A nozzle position box 614 allows the user to assign a nozzle position to each spacer size.

Figure 31A:
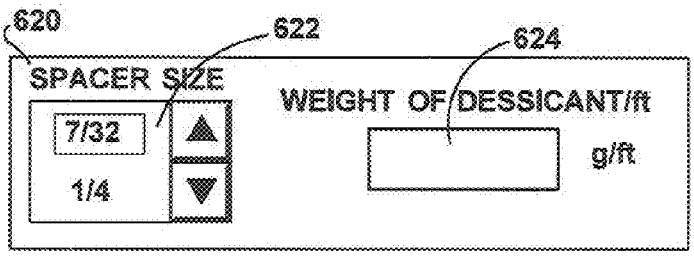
FIG. 31A is an illustration of a desiccant amount setup screen.

FIG. 31A illustrates an amount of desiccant by weight setup screen 240. A spacer size selection box 622 allows the user to select each spacer size. A weight of desiccant per unit length input box 624 allows the user to input the weight of desiccant per unit of spacer frame length for each spacer frame size.

Figure 31B:
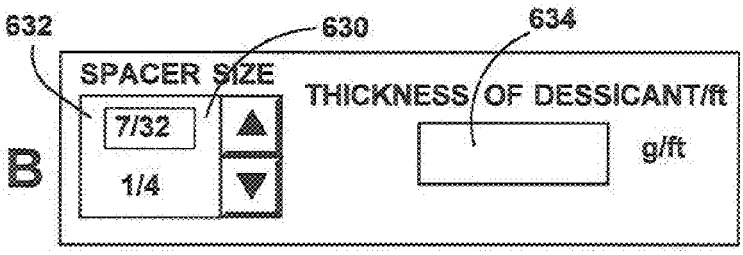
FIG. 31B is an illustration of a desiccant amount setup screen.

FIG. 31B illustrates a thickness of desiccant screen 630, which may be used by the user instead of by the weight setup screen 620. A spacer size selection box 632 allows the user to select each spacer size. A thickness of desiccant box 634 allows the user to input the designed thickness of desiccant to be applied to the selected spacer frame width.

Figure 32:
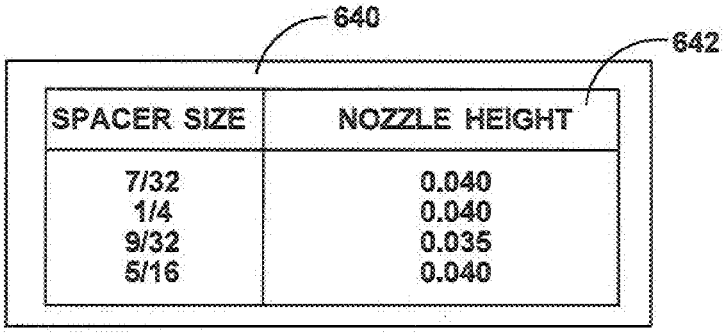
FIG. 32 is an illustration of a nozzle height setup screen.

FIG. 32 illustrates a nozzle height setup screen 640. A nozzle height box allows the user to assign a nozzle height to each spacer size.

The controller 232 controls the speed of the conveyor 230, the pressure supplied by the desiccant bulk supply 236, the speed at which the motor 298 turns the desiccant gear pump 276, and the time at which the indexed desiccant gun 300 dispenses desiccant as well as other parameters.

By supplying desiccant 214 to the gear pumps 276 at an appropriate pressure (typically between 600 psi and 1500 psi) and controlling the speed at which the motor drives the gear pump, the volumetric flow rate of desiccant 214 is accurately controlled.

The required volumetric flow and speed at which the desiccant motor 298 drives the desiccant pump 276 is calculated by the controller 232. The required volumetric flow of desiccant 214 is equal to the cross-sectional area of the desiccant applied multiplied by the velocity of the elongated window spacer 216 along the conveyor 230. The required pump speed is equal to the required volumetric flow of desiccant 214 divided by the volume of desiccant flow produced for each revolution of the desiccant pump 276.

In the embodiment where the mass or volume of the desiccant 214 per length of window spacer 216 is inputted into the controller 232, via the touch screen 335. The controller 232 calculates the required volumetric flow of desiccant 214 by multiplying the inputted mass per elongated window spacer 216 length by the speed of the conveyor 230. The speed at which the desiccant pump 276 must be driven by the desiccant gear pump motor 298 is equal to the required desiccant volumetric flow rate divided by the flow created by each revolution of the desiccant gear pump 276.

The indexed nozzle 225 is selected, the height of the indexed nozzle is adjusted, and the distance between the conveyor guides 318*a*, 318*b* are adjusted automatically by servo motors based on the widths of elongated spacer members scheduled to be processed by the system. An elongated window spacer 216 is placed on the conveyor 230 (either manually or automatically by an automated delivery device or from a machine that forms elongated spacers from ribbon stock) with the outer wall 220 in contact with the conveyor 230 and the glass abutting walls 218*a*, 218*b* constrained by the conveyor guides 318*a*, 318*b*. The rolling guides 319 hold the elongated spacer 316 firmly against the conveyor 230 as the spacer is moved along the conveyor. The conveyor 230 moves the elongated window spacer 216 toward the desiccant metering and dispensing assembly 234. The leading edge 422, gas holes 424 and trailing edge 426 of the elongated window spacer pass beneath the desiccant fiber optic sensor 420. The desiccant fiber optic sensor 420 senses the leading edge, the gas holes 424 and the trailing edge 426 and provides a signal to the controller 232 indicating the time at which the leading edge, gas holes and trailing edge pass beneath the desiccant fiber optic sensor 320. The controller 232, uses the input from the desiccant fiber optic sensor and the speed of the conveyor 230 to calculate the time at which the leading edge, gas holes and trailing edge of the elongated window spacer 216 will pass the indexed nozzle 225.

Referring to FIG. 8, the elongated window spacer 216 is moved by the conveyor 230 past the desiccant dispensing gun 300. When the leading edge 422 of the elongated window spacer 216 reaches the indexed nozzle 225, desiccant 214 is dispensed into the interior region 222 of the elongated spacer beginning at the leading edge. Desiccant 214 is applied to the interior region as the elongated spacer is moved past the desiccant dispensing gun 300. The desiccant gear pump motor 298 drives the desiccant gear pump 276 at the required speed to supply the desired amount of desiccant 214 into the interior region 222 of the elongated window spacer 216.

In one embodiment, when a gas hole 424 of the elongated window spacer 216 passes beneath the desiccant dispensing gun 300, dispensing of desiccant into the interior region 422 is temporarily stopped, leaving the gas holes 424 open. In the exemplary embodiment, the controller 232 causes the desiccant dispensing gun 300 to begin dispensing desiccant again after the gas hole 424 passes the desiccant dispensing gun 300. In an alternate embodiment, desiccant 214 is applied over the gas holes 424. In this embodiment, the controller 232 causes the desiccant dispensing gun 300 to continue dispensing desiccant 214 as each gas hole 424 passes beneath the desiccant dispensing gun 300. This option of applying desiccant over the gas holes, may be programmed by the user into the controller 232 via the touch screen 335 during the setup sequence.

The desiccant dispensing gun 300 continues to dispense desiccant 214 into the interior region 222 until the trailing edge 426 of the elongated window spacer 216 is reached. In one embodiment, the controller stops dispensing of desiccant 214 at the trailing edge 426 of the elongated window spacer 216 based on the position of the trailing edge 426 sensed by the desiccant fiber optic sensor 420. In an alternate embodiment, the controller 232 stops dispensing of desiccant 214 into the interior region 222 based on a length parameter that is inputted into the controller 232 via the touch screen 335.

Although the present invention has been described with a degree of particularity, it is the intent that the invention include all modifications and alterations falling within the spirit or scope of the appended claims.

The invention claimed is:

1. A system for controlled dispensing of a desiccant material into an interior region of an elongated spacer frame member, comprising:

a) a plurality of nozzles for dispensing the desiccant material into the interior region of the elongated spacer frame member;

b) an actuator for selectively indexing each of the plurality of nozzles to a delivery site located along a path of travel of the elongated spacer frame member;

c) a conveyor for moving the elongated spacer frame member along the path of travel relative to the delivery site at a controlled speed;

d) a controller configured to select one nozzle for indexing to the delivery site based on a width of an elongated spacer frame member approaching the delivery site.

2. The system of claim 1 wherein the controller selects the one nozzle to deliver desiccant to a range of elongated spacer frame widths.

3. The system of claim I wherein the controller is configured to vertically adjust the one nozzle with respect to the path of travel based on a width of an elongated spacer frame member approaching the delivery site.

4. The system of claim 1 wherein the controller is configured to monitor a width of the elongated spacer frame member and vertically adjust the one nozzle with respect to the elongated spacer frame member to a distance above the spacer frame member that corresponds to the width of the spacer frame member.

5. The system of claim 1 wherein the controller is configured to adjust a width of the desiccant material applied by the nozzle at the delivery site to the elongated spacer frame member by adjusting a relative distance between the spacer frame member and the nozzle at the delivery site.

6. The system of claim 1 further comprising a linearly moving nozzle plate controlled by the controller to selectively index one of the plurality of nozzles to the delivery site.

7. The system of claim 1 further comprising a rotatable nozzle turret controlled by the controller to selectively index one of the plurality of nozzles to the delivery site.

8. A system for controlled dispensing of a desiccant material into an interior region of an elongated spacer frame member, comprising:

a) a nozzle for dispensing the desiccant material into the interior region of the elongated spacer frame member;

b) an actuator for positioning the nozzle above a delivery site located along a path of travel of the elongated spacer frame member;

c) a conveyor for moving the elongated spacer frame member along the path of travel relative to the delivery site at a controlled speed; and d) a controller configured to determine a distance between the nozzle and the elongated spacer frame member at the delivery site based on a width of an elongated spacer frame member approaching the delivery site.

9. A system for controlled dispensing of a desiccant material into an interior region of an elongated spacer frame member, comprising:

a) a plurality of nozzles for dispensing the desiccant material into the interior region of the elongated spacer frame member;

b) an actuator for selectively indexing each of the plurality of nozzles to a delivery site located along a path of travel of the elongated spacer frame member;

c) a conveyor for moving the elongated spacer frame member along the path of travel relative to the delivery site at a controlled speed;

d) a controller configured to monitor widths of elongated spacer frame members conveyed to the delivery site, select a nozzle for indexing to the delivery site based on a width of an elongated spacer frame member conveyed to the delivery site, and determine a distance between the nozzle and the elongated spacer frame member at the delivery site based on a width of an elongated spacer frame member conveyed to the delivery site.

10. The system of claim 8 wherein the controller is configured to vertically adjust the nozzle with respect to the path of travel based on a width of an elongated spacer frame member approaching the delivery site.

11. The system of claim 8 wherein the controller configured to monitor a width of the elongated spacer frame member and vertically adjust the nozzle with respect to the elongated spacer frame member to a distance above the spacer frame member that corresponds to the width of the spacer frame member.

12. The system of claim 8 wherein the controller is configured to adjust a width of the desiccant material applied by the nozzle at the delivery site to the elongated spacer frame member by adjusting a relative distance between the spacer frame member and the nozzle at the delivery site.

13. The system of claim 8 further comprising a linearly moving nozzle plate controlled by the controller to selectively index one of the plurality of nozzles to the delivery site.

14. The system of claim 8 further comprising a rotatable nozzle turret controlled by the controller to selectively index one of the plurality of nozzles to the delivery site.

15. The system of claim 9 wherein the controller is configured to vertically adjust the nozzle with respect to the path of travel based on a width of an elongated spacer frame member approaching the delivery site.

16. The system of claim 9 wherein the controller is configured to monitor a width of the elongated spacer frame member and vertically adjust the nozzle with respect to the elongated spacer frame member to a distance above the spacer frame member that corresponds to the width of the spacer frame member.

17. The system of claim 9 further comprising a rotatable nozzle turret controlled by the controller to selectively index one of the plurality of nozzles to the delivery site.

18. An apparatus for dispensing a controlled amount of desiccant material into an interior region of an elongated spacer frame member comprising:

a) a plurality of nozzles for dispensing the desiccant material into the interior region of the elongated spacer frame member;

b) a first actuator for selectively indexing each of the plurality of nozzles to a delivery site located along a path of travel of the elongated spacer frame member;

c) a conveyor for moving the elongated spacer frame member along the path of travel relative to the delivery site at a controlled speed;

d) a controller configured to monitor widths of elongated spacer frame members conveyed to the delivery site, select a dispensing nozzle from the plurality of nozzles, index the selected dispensing nozzle to the delivery site based on a width of an elongated spacer frame member conveyed to the delivery site, and determine a distance between the dispensing nozzle and the elongated spacer frame member at the delivery site based on a width of an elongated spacer frame member conveyed to the delivery site; and e) a second actuator for selectively positioning said dispensing nozzle with respect to the path of travel based on said controller's monitoring of the width of an elongated spacer frame member approaching the delivery site.

19. The apparatus of claim 18 wherein said second actuator' selective positioning of said dispensing nozzle by said controller comprises a vertical positioning with respect to said path of travel.

* * * * *